US005082452A

United States Patent [19]

Takano

[11] Patent Number: 5,082,452

[45] Date of Patent: Jan. 21, 1992

[54] CLAMP-TYPE ELECTRICAL CONNECTORS

[75] Inventor: Tsunesuke Takano, Tokyo, Japan

[73] Assignee: Daiichi Denso Buhin Co., Ltd., Tokyo, Japan

[21] Appl. No.: 454,747

[22] Filed: Dec. 21, 1989

[30] Foreign Application Priority Data

| | | | |
|---|---|---|---|
| Dec. 21, 1988 | [JP] | Japan | 63-165335[U] |
| Feb. 20, 1989 | [JP] | Japan | 1-18789[U] |
| Mar. 23, 1989 | [JP] | Japan | 1-32841[U] |
| Mar. 23, 1989 | [JP] | Japan | 1-32842[U] |

[51] Int. Cl.[5] ..... H01R 13/18

[52] U.S. Cl. ..... 439/206; 439/621; 439/850

[58] Field of Search ..... 439/621, 622, 830, 843, 439/845, 849, 850, 206

[56] References Cited

U.S. PATENT DOCUMENTS

| | | | |
|---|---|---|---|
| 3,229,066 | 1/1966 | Rowe | 439/622 |
| 3,262,088 | 7/1966 | West | 439/849 |
| 3,444,502 | 5/1969 | Matthews | 439/621 |
| 3,486,154 | 12/1969 | Seagrave et al. | 439/622 |
| 4,585,292 | 4/1986 | Frantz et al. | 439/610 |
| 4,671,586 | 6/1987 | Debolt | 439/126 |
| 4,872,262 | 10/1989 | Marach | 439/621 |

FOREIGN PATENT DOCUMENTS

| | | | |
|---|---|---|---|
| 2226093 | 11/1974 | France | 439/833 |
| 50-36658 | 10/1975 | Japan . | |
| 439642 | 12/1935 | United Kingdom | 439/206 |
| 2092398 | 8/1982 | United Kingdom | 439/621 |
| 2096413 | 10/1982 | United Kingdom | 439/622 |

*Primary Examiner*—Gary F. Paumen
*Attorney, Agent, or Firm*—Nixon & Vanderhye

[57] ABSTRACT

Electrical connectors are provided with an electrically insulating base member having a connector mounting portion from which at least one pair of mounting lugs extend from an interior surface thereof. A pair of spaced-apart clamp-type connectors, each of which includes a clamp member having a generally U-shaped portion, are provided so as to resiliently engage (and thus mount) an electrical component (e.g., a cylindrical type lamp). The connectors define mounting holes for receiving a respective one of the mounting lugs, whereby the connectors are mounted to said insulating base member. A pair of ribs is provided on the connectors (preferably adjacent the mounting holes) so as to establish a vent space between said connectors and the interior surface of the base member's connector mounting portion. The established vent space allows heat generated during use of the electrical component to dissipate.

9 Claims, 29 Drawing Sheets

FIG. 54
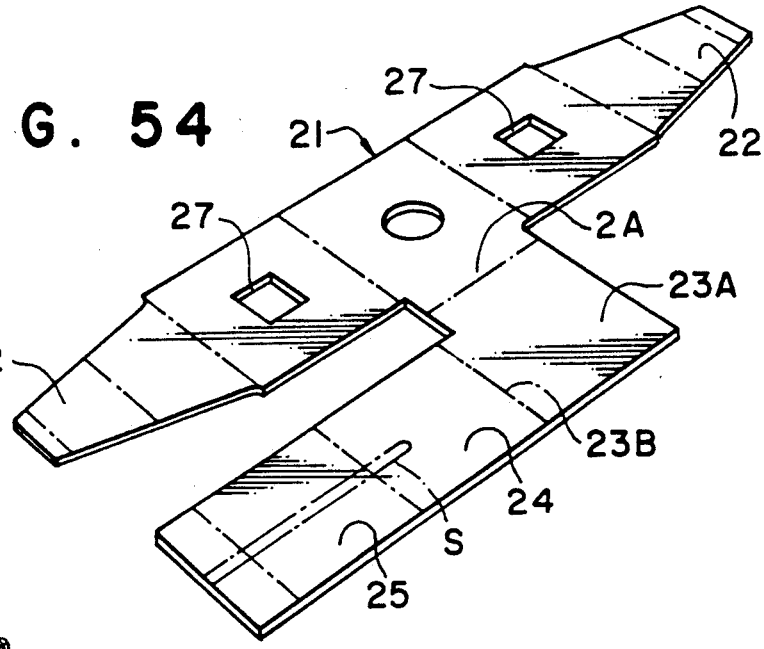
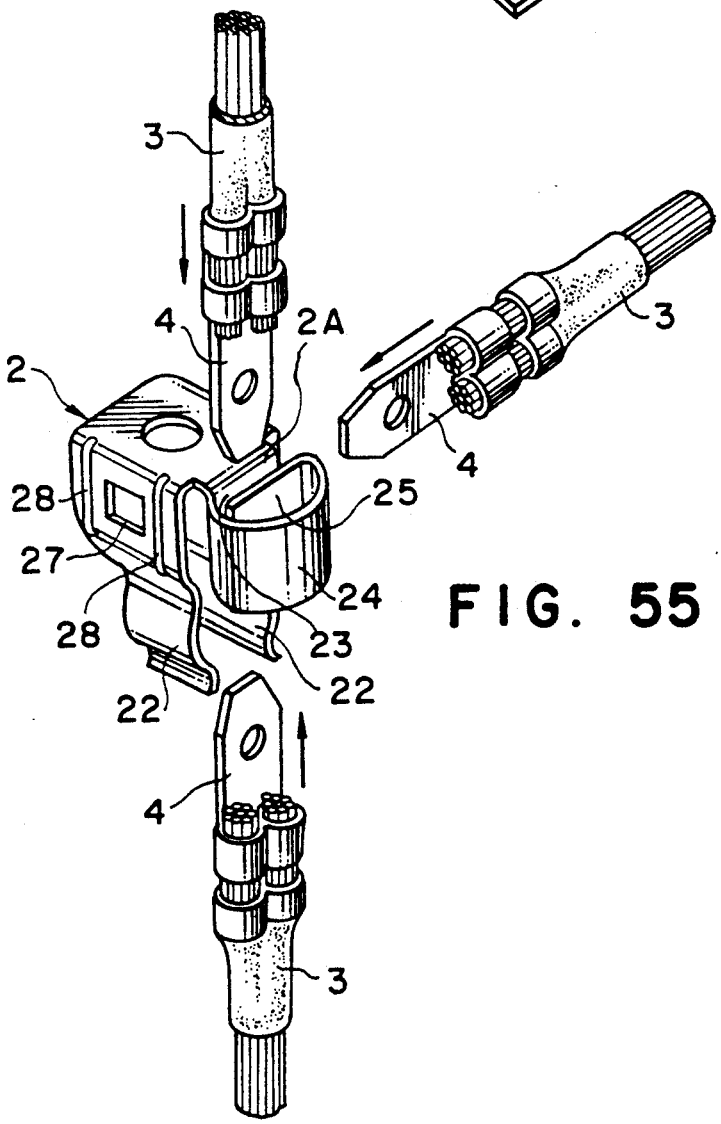
FIG. 55

CLAMP-TYPE ELECTRICAL CONNECTORS

BACKGROUND AND SUMMARY OF THE INVENTION (a) Field of Invention

The present invention generally relates to clamp-type electrical connectors suitable for connecting a straight tube-type lamp, a glass tube fuse and the like to external pieces, such as tab terminals and the like.

(b) Prior Art Discussion

Electrical connectors of a type similar to those of the present invention are described for example, in Japanese Utility Model Publication No. 50-36658. The connection devices disclosed in Japanese Utility Model Publication No. 50-36658 characterized by comprising fuse-receiving fittings composed of a metal plate of an elastic conducting member bent to a C-shaped cross section and having a pair of elongate slots defined on opposite sides thereof. The metal plate has tapered surfaces inclining inwardly and arc-shaped supports for clamping the opposite ends thereof. Locking lugs including a pair of locking recesses confronting the elongate slots of the receiving fittings are disposed at the side edges of a fuse box main body where the fuse receiving fittings are mounted. In such a manner, the fuse box main body (formed of an insulating material) is provided with a number of rectangular through hole pairs to enable the receiving fittings to be mounted form the lower surface. The locking lugs (including the locking recesses) are disposed at the side edges of the mounting through holes of the fuse box main body. The elongate holes engageable with the lugs are defined on the sides of the fuse-receiving fittings so that one side of each elongate hole is engaged with the locking recess of a respective locking lug. As a result, the fuse-receiving fittings are detachably coupled to the main body.

In the above-described conventional connector device, the fuse-receiving fitting is connected to other conductive members in such a manner that a lead wire or the like is connected to the fuse-receiving fitting by means of soldering or by means of a caulked narrow band-shaped conductive plates (typically known as a bus bar).

Therefore, the conventional connecting devices are problematic since the task of connecting the lead wires can be particularly difficult—especially when the task is being performed in a small and/or dark space (such as the engine compartment of an automobile and the like). In addition, tools for wire connection, such as soldering irons, caulking tools and the like are usually required.

An object of the present invention is therefore to enable other conductive members to be connected easily and securely to a holding socket type connector.

(c) Summary of the Invention

The above-noted object of the present invention is achieved by providing a clamp type connection device comprising an insulating substrate having a connector mounting portion including confronting lugs formed thereto and connectors each integrally provided with a pair of clamping pieces made of a conductive plate having elasticity and a plug-in connection piece, wherein each of the connectors is mounted on the connector mounting portion by mounting holes defined on the base of the clamping pieces and the plug-in connection piece having a plug-in connecting portion, a straight tube lamp, a glass tube fuse and the like can be clamped by being tightly held by the pair of the clamping pieces, and a tab terminal and a bus bar can be directly and tightly inserted into the plug-in connection piece for use.

A gap formed between the inner surface of the mounting portion and the outer surface of the connector by raised ribs enables heat from the connector to be dissipated by the chimney effect of the gap. The raised ribs also increase the flexural rigidity of the base of the pair of the clamping pieces.

BRIEF DESCRIPTION OF THE ACCOMPANYING DRAWINGS

FIG. 1 to FIG. 16 show an embodiment of the present invention wherein:

FIG. 1 is a perspective view showing the state that connectors are separated from an insulation substrate;

FIG. 2 is a perspective view of the above connectors and the insulating substrate in use after they have been assembled;

FIG. 3 is a perspective view of an unfolded embodiment of the connector;

FIG. 4 is a perspective view showing an embodiment of a connector applied to a device according to the present invention;

FIG. 5 to FIG. 10 are perspective views of other embodiments of the connector shown in FIG. 4;

FIG. 11 is a perspective view showing the state that the connectors shown in FIG. 10 are separated from an insulating substrate;

FIG. 12 is a perspective view of the above connectors and the insulating substrate in use after they have been assembled;

FIG. 13 is a separated perspective view showing a case in which another insulating substrate is used in place of the insulating substrate shown in FIG. 11;

FIG. 14 is a perspective view showing connectors suing the unfolded embodiment shown in FIG. 14;

FIGS. 15 and 16 are perspective views showing connectors using the unfolded embodiment shown in FIG. 14;

FIG. 17 to FIG. 71 are diagrams showing other embodiments according to the present invention, wherein:

FIGS. 17 to FIG. 28, FIGS. 34 to FIG. 46, and FIG. 52 to FIG. 65 are perspective views of the main parts of other embodiments according to the present invention, respectively; and FIG. 29 to FIG. 33, FIG. 47 to FIG. 51, and FIG. 66 to FIG. 71 are cross-sectional views of other embodiments according to the present invention.

DETAILED DESCRIPTION OF THE INVENTION

Preferred embodiments of the present invention will be described with reference to the accompanying drawings.

Figure 1:
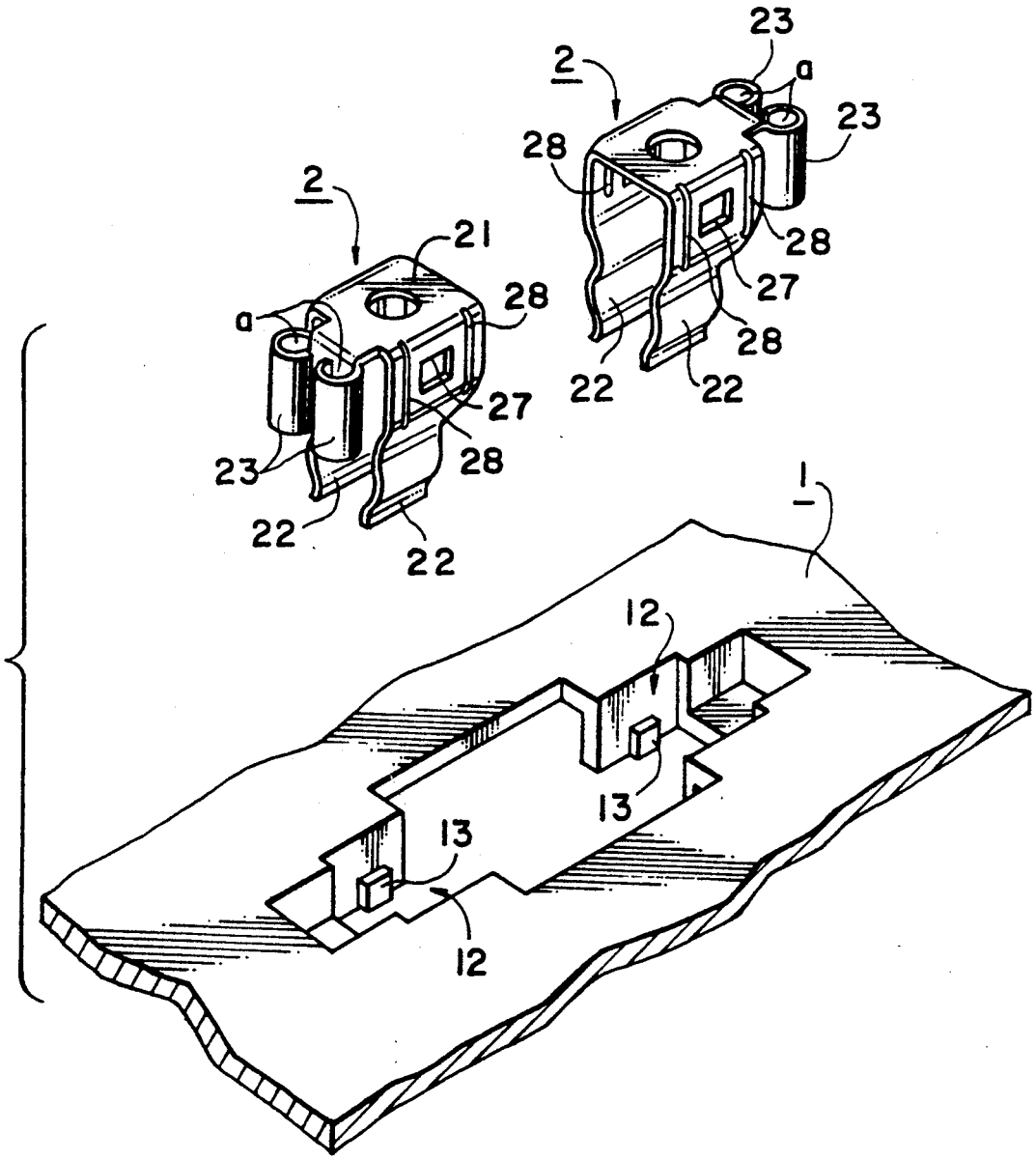
Figure 4:
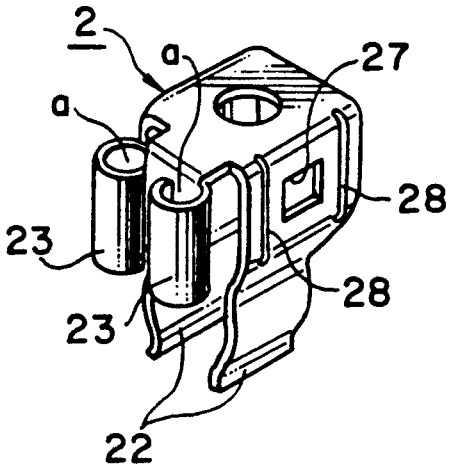
Figure 5:
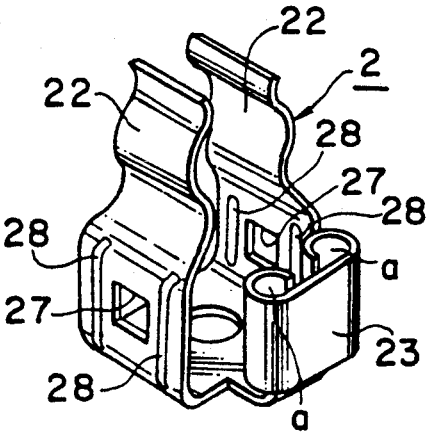
Figure 8:
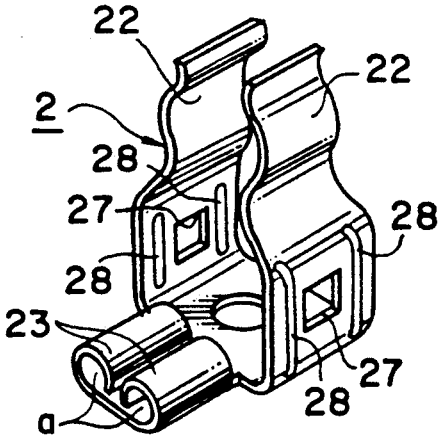
Figure 6:
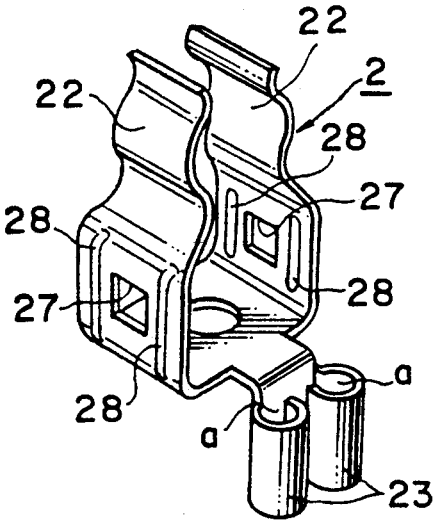
Figure 9:
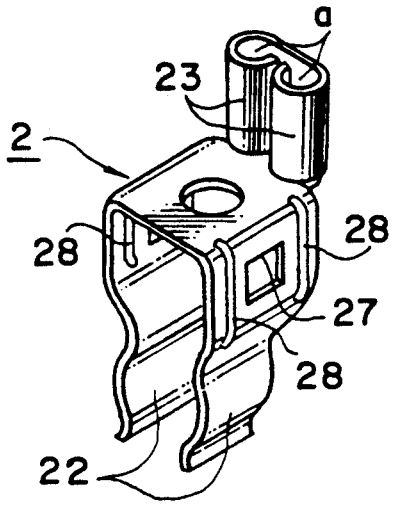
Figure 7:
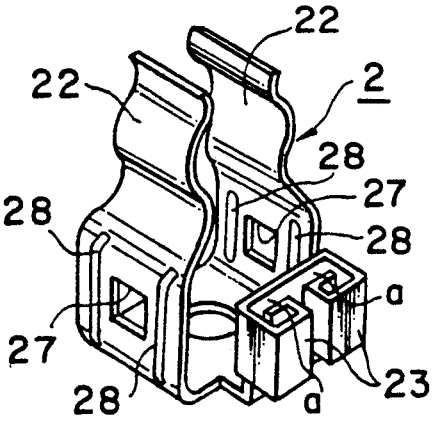

As shown more specifically in FIG. 1, connection device according to the present invention includes connectors 2 mounted on an insulation substrate 1. The insulation substrate 1 has a connector mounting portion 12 formed thereon which includes confronting lugs 13, 13. Each of the connectors 2 is integrally provided with a pair of clamping pieces 22, 22 composed of resilient conductive plates as shown in FIGS. 1 and 4 and a plug-in connection piece 23.

The above connectors 2 are mounted on the socket mounting portion 12 by means of lugs 14 engaging a respective one of the mounting holes 27 defined on the base of the clamping pieces 22.

The insulation substrate 1 is made, for example, by plastics molding techniques, and as shown in FIG. 1, has mounting portions 12 for receiving a pair of connectors 2 defined on the upper surface thereof at prescribed intervals.

The mounting portions 12 each project outwardly with respect to the upper surface of the substrate 1 and is opened at the lower surface thereof. A pair of lugs 13 to be engageably locked with a respective connector 2 defined on the confronting inner walls of the mounting portion 12 is also provided.

Figure 3:
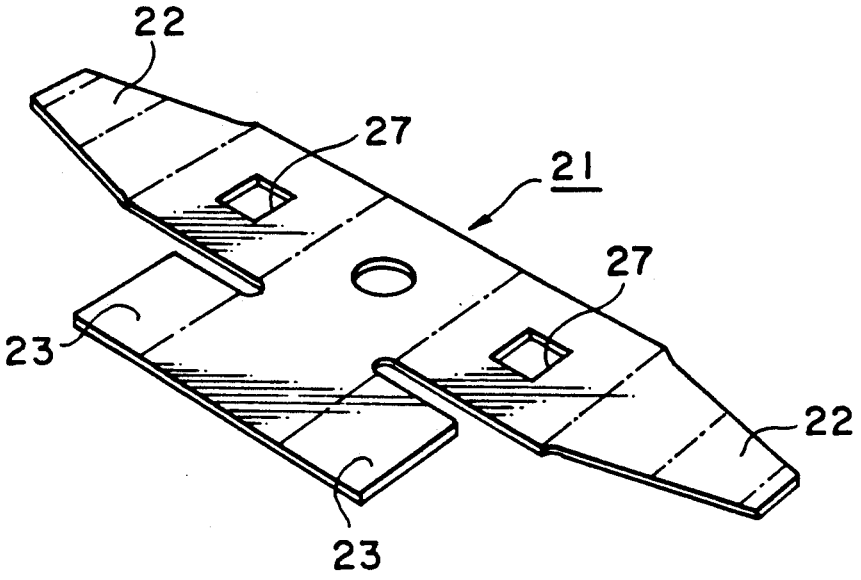

The connector 2 is formed as shown in FIGS. 1 and 4 in such a manner that a conductive plate 21 (preferably formed of a conductive spring plate of phosphor bronze, nickel silver, beryllium copper or the like) is punched substantially into the shape as shown in FIG. 3—that is, substantially bent to a U-shape to form a bottom at a separating portion. Thus, a pair of the clamping pieces 22 serving as a holding socket are provided. The plug-in connection piece 23 extending from a side of the above bottom is substantially formed to the shape shown in FIG. 4 at the same level with the bottom and is bent in parallel with the pair of the clamping pieces 22.

The pair of clamping pieces 22 define the mounting holes through which the lugs 13 in the socket mounting portion 12 are locked. The clamping pieces 22 also define a pair of raised ribs for reinforcing the clamping pieces 22 and for establishing a space between the inner wall of the socket mounting portion 12 and the connector 2 so as to provide a vent (chimney) to allow for heat dissipation.

Figure 2:
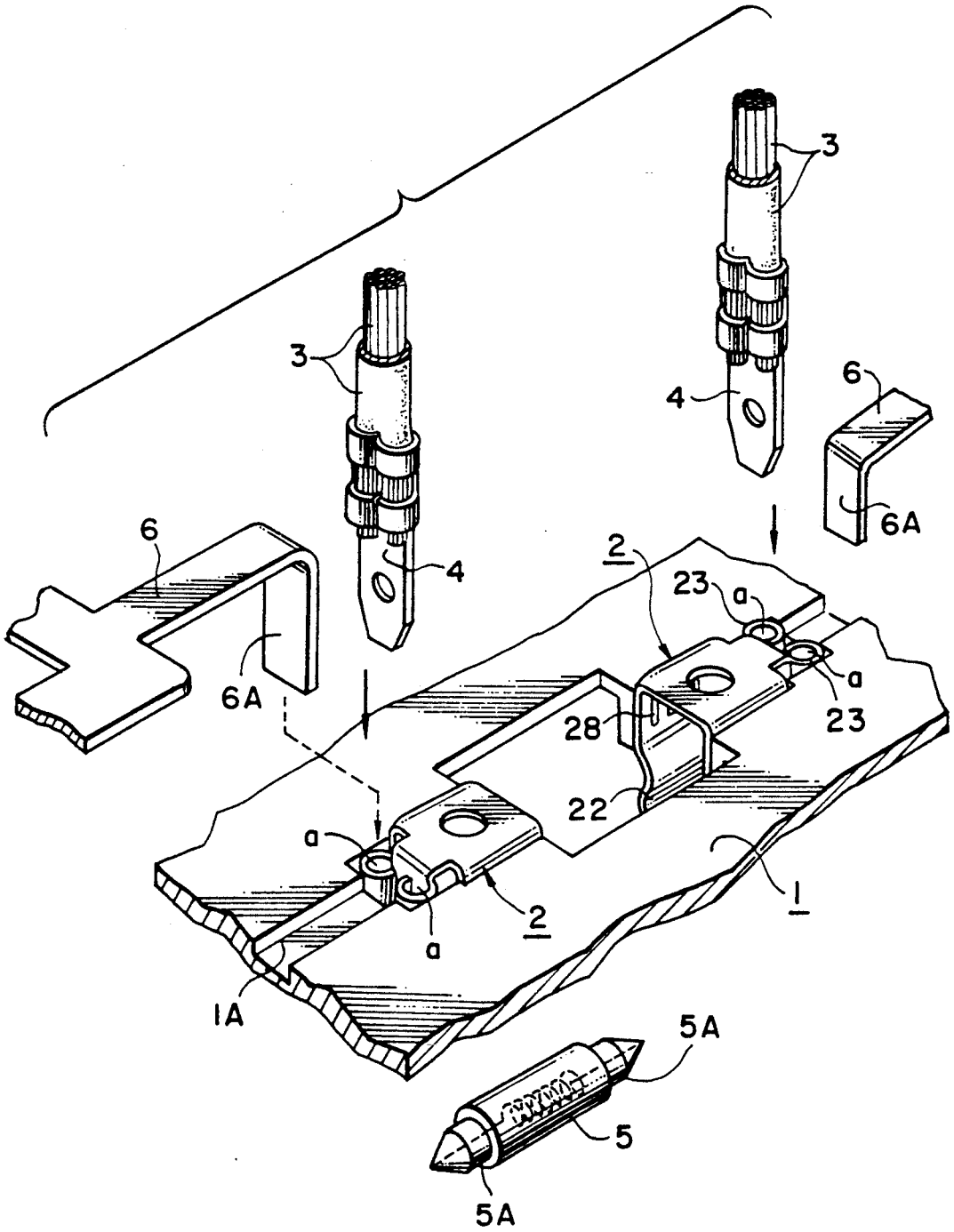

As shown in FIG. 2, each of the connectors 2 is mounted in such a manner that the mounting holes 27 defined on each base of the pair of the clamping pieces 22 are inserted into the lugs 13 confrontingly disposed on the confronting wall surfaces of the connector mounting portion 12 of the above insulating substrate 1.

After the connectors 2 have been mounted, known tab terminals to which lead wires 3 are press-fitted tightly into a respective one of the connecting portions a of the plug-in connection pieces 23. The conductive members 5A, 5A of a straight tube-type lamp 5 are then mounted between the pair of the clamping pieces 22.

Members shown by reference numeral 6 in FIG. 2 are band-shaped narrow conductive plates known as "bus bars" and can be used with the upright portions 6A, 6A thereof tightly inserted into the connecting portions a of the plug-in connection pieces 23 of the above-described connector 2. In this case, however, grooves lA are preferably defined on the surface of the insulating substrate 1 to accommodate the band-shaped narrow conductive plates 6.

The plug-in connection plate 23 of connector 2 in the present invention can be formed in many different orientations as shown in FIGS. 5 to 10.

Figure 10:
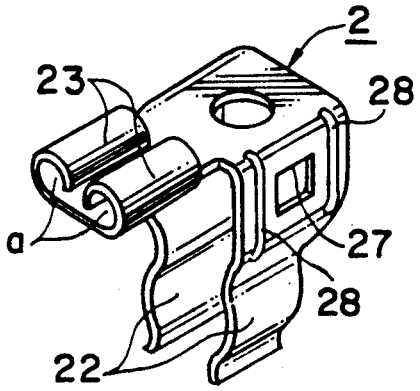
Figure 11:
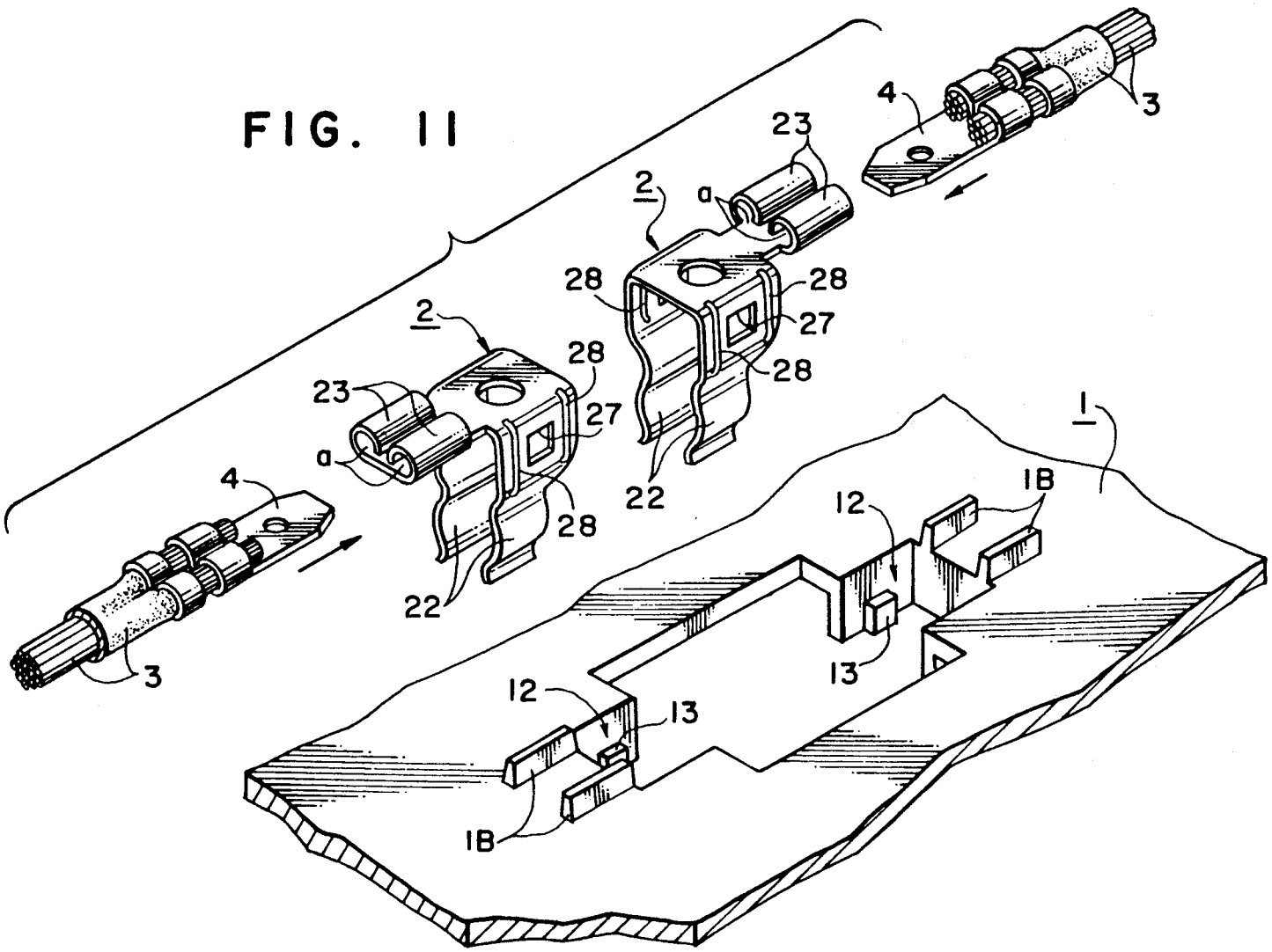
Figure 12:
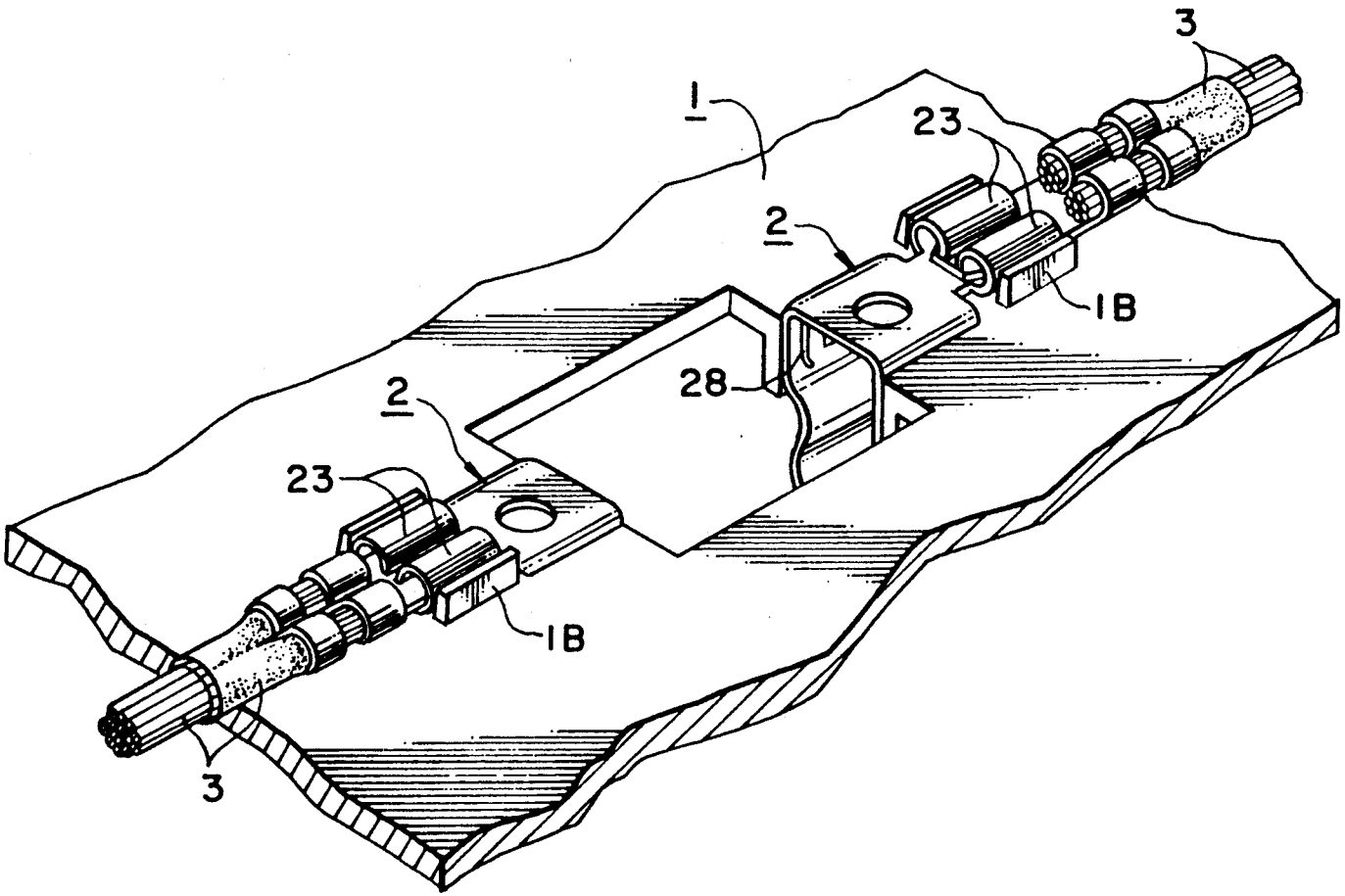
Figure 13:
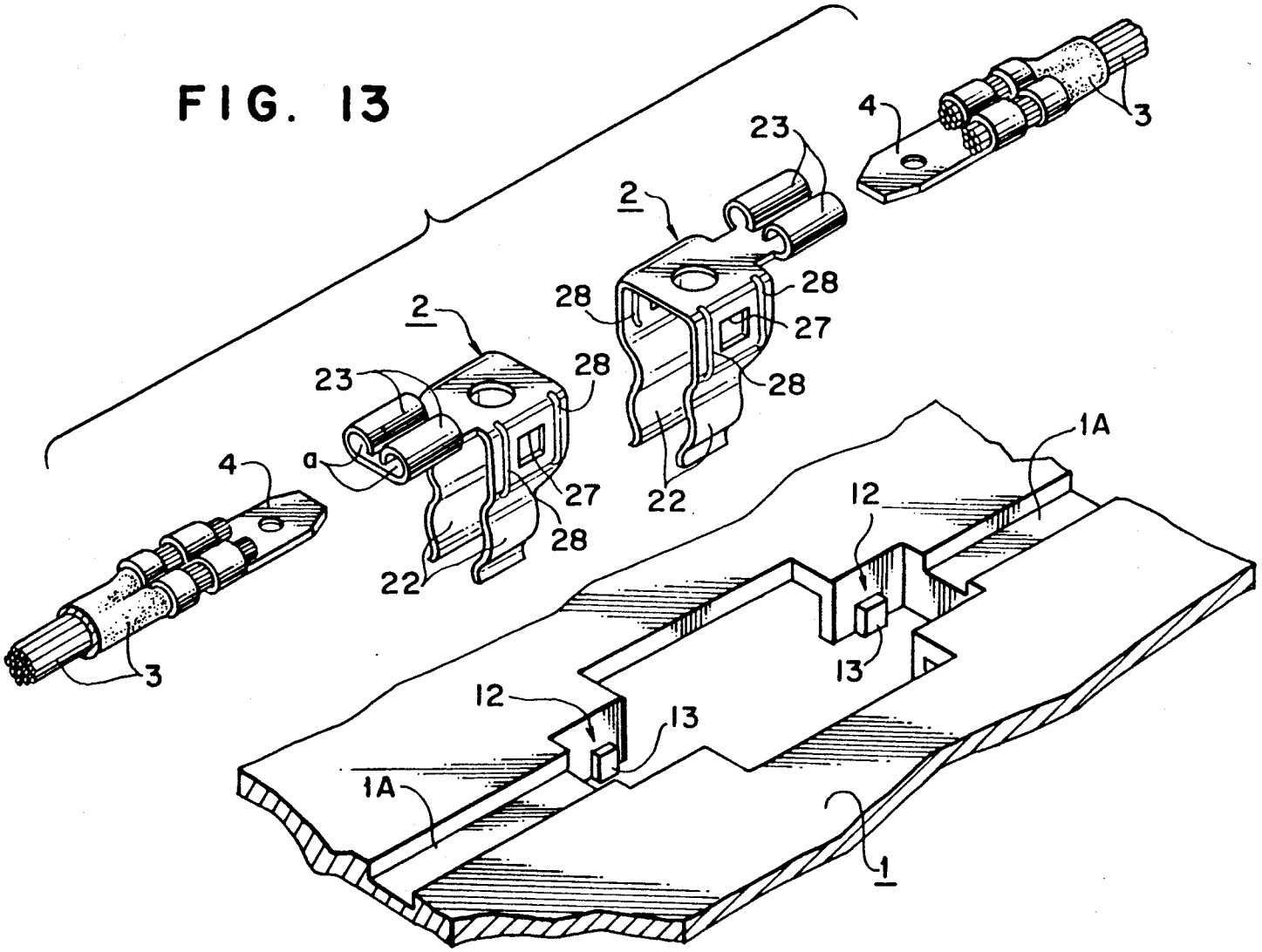

A connector shown in FIG. 10 can be mounted as shown in FIG. 12 through a state shown in FIG. 11. In this case, however, it is preferable either that (i) a pair of ribs 1B, 1B project from the insulating substrate 1 to regulate the position of the plug-in connection piece in the horizontal direction (as shown in the above respective FIGS.) or (ii) that grooves lA are defined on the surface of the insulating substrate 1 to regulate the position of tab terminals 4 and lead wires 3 as shown in FIG. 13.

It should be noted here that like reference numerals in FIGS. 1-2 and 11-13 refer to like structural elements.

Figure 14:
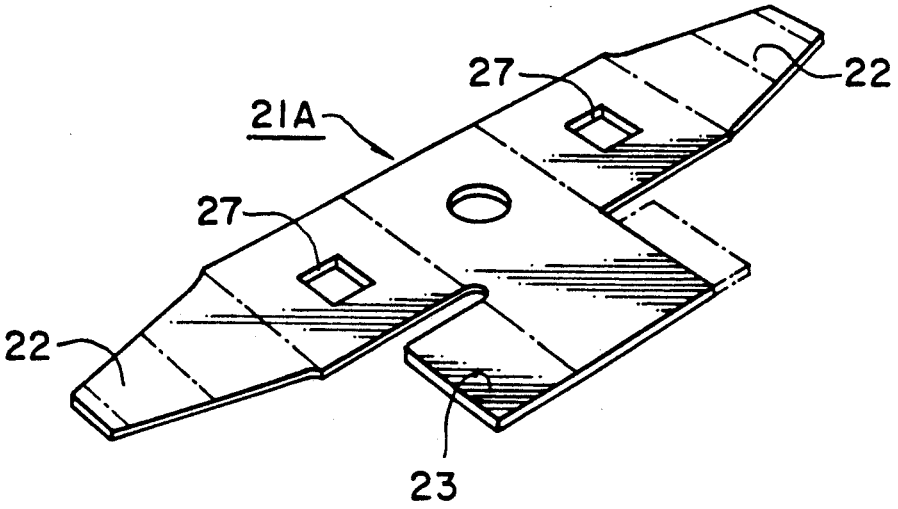
Figure 15:
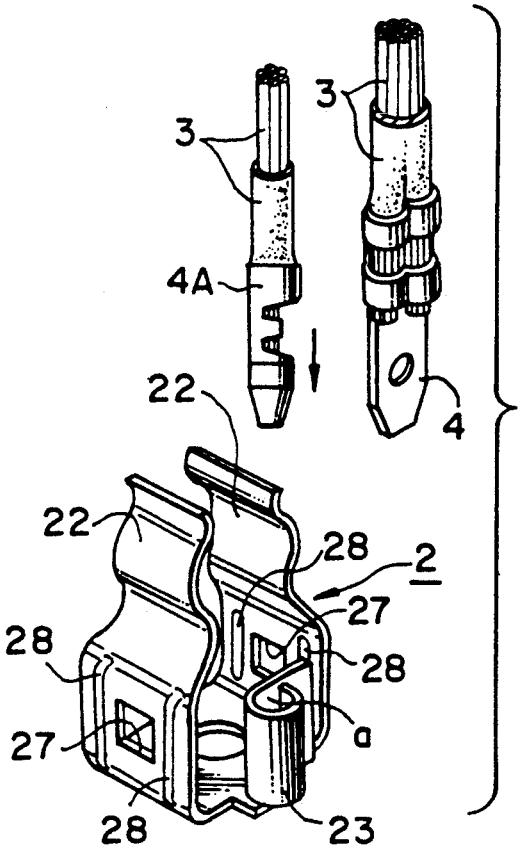
Figure 16:
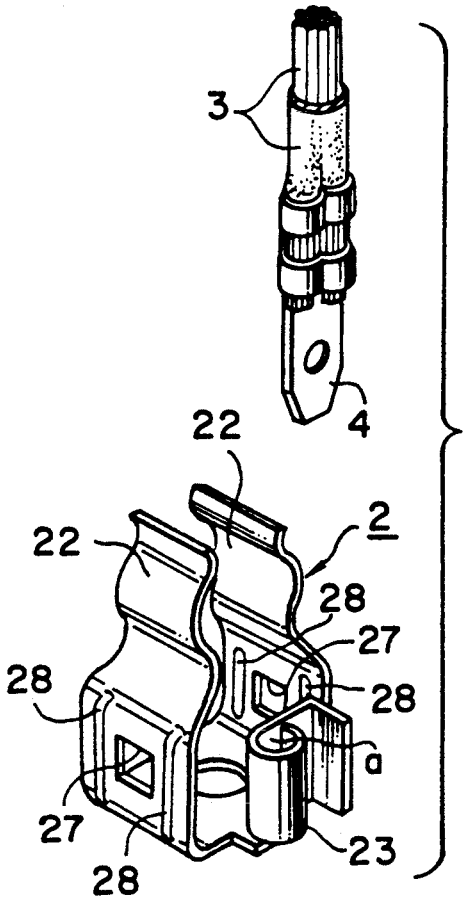

The clamp type connection device according to the present invention can include a conductive plate 21A having a shape shown in FIG. 14 by folding it to shapes shown in FIGS. 15 and 16. The embodiments shown in FIGS. 15 and 16 are essentially the same as the previous embodiments, except that the plug-in connection piece is asymmetrical. Thus, a tab terminal 4 and a partially cutout cylindrical connection plug 4A can be inserted into a single plug-in portion a for use.

Figure 17:
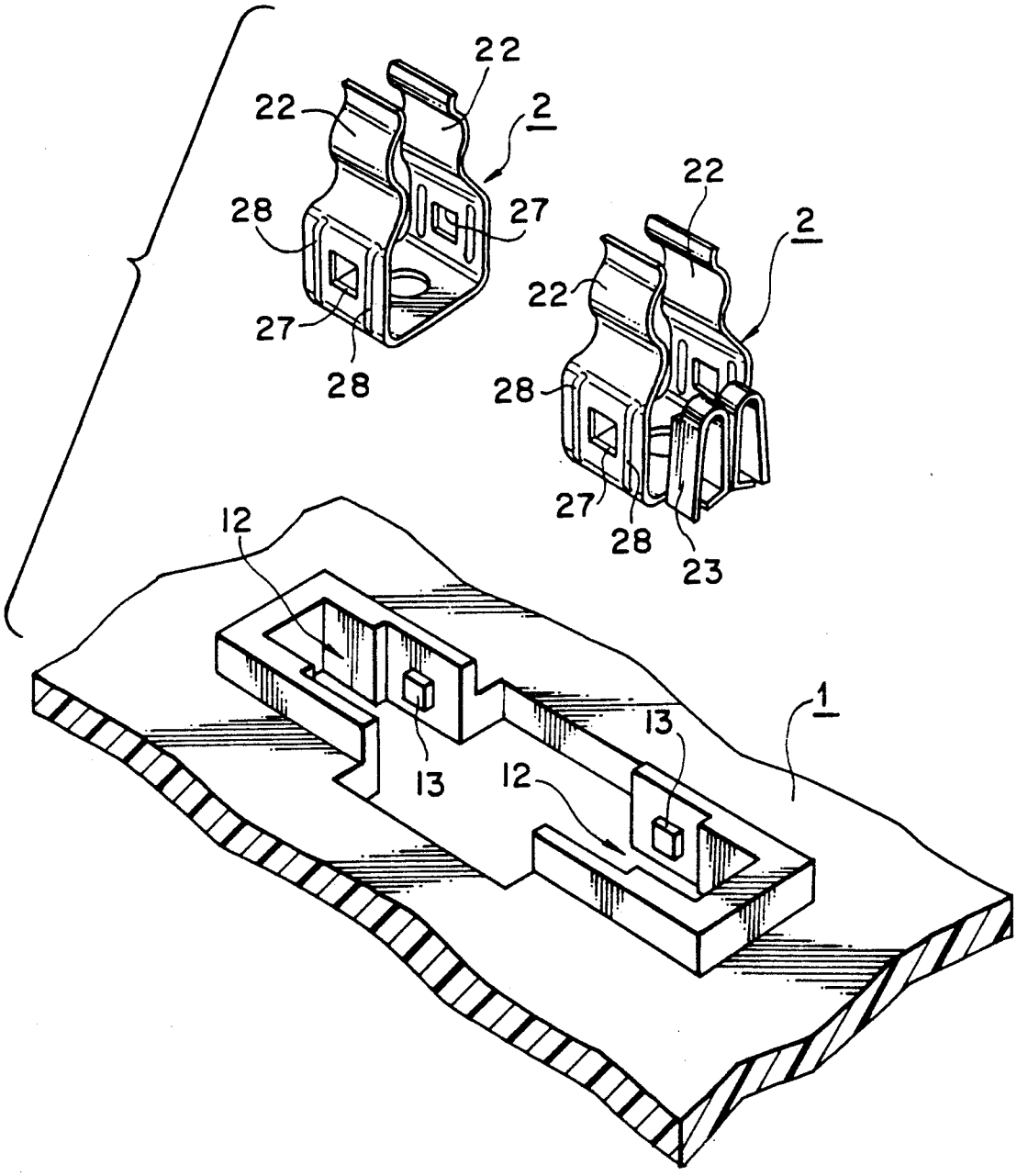
Figure 18:
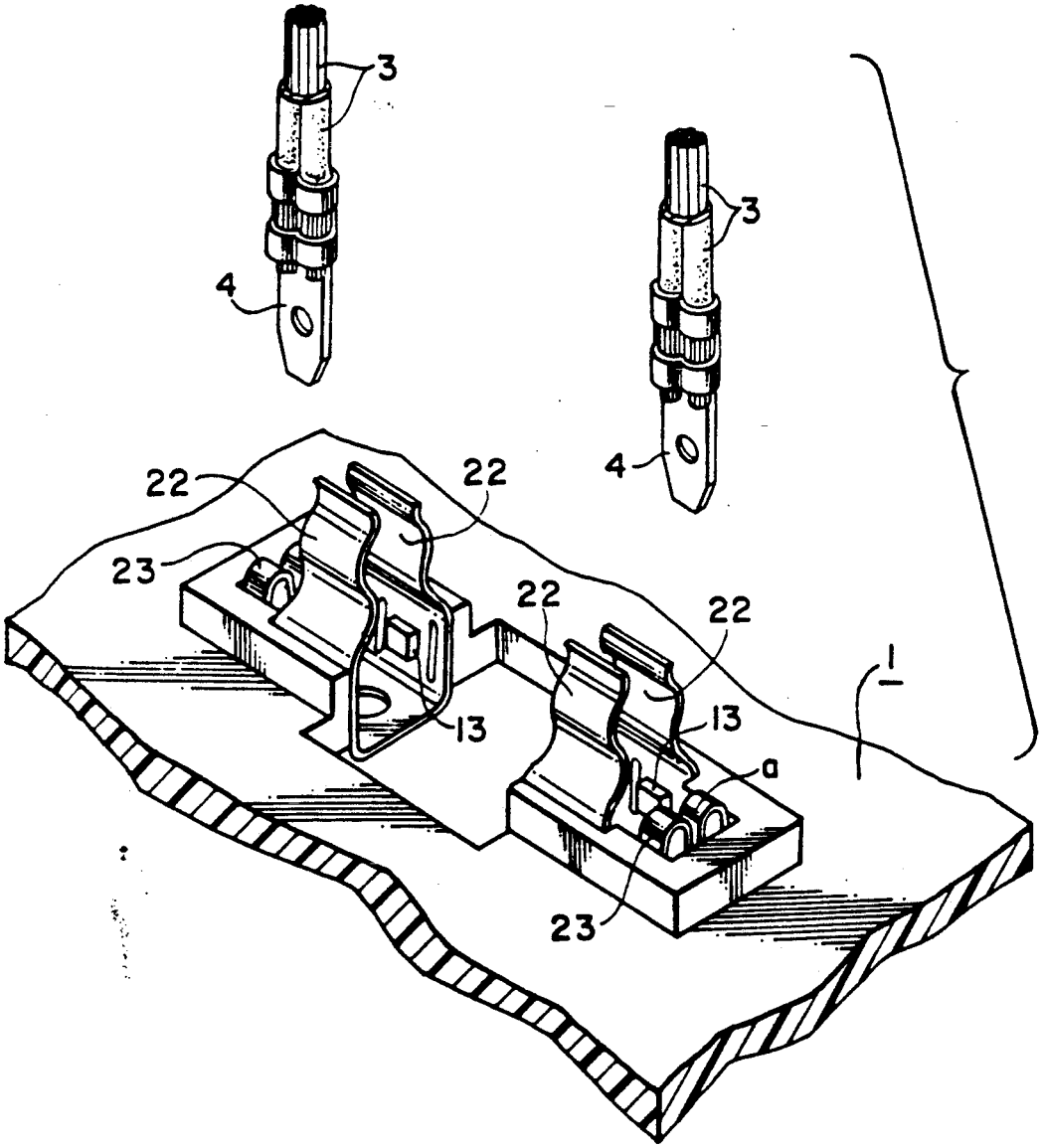
Figure 19:
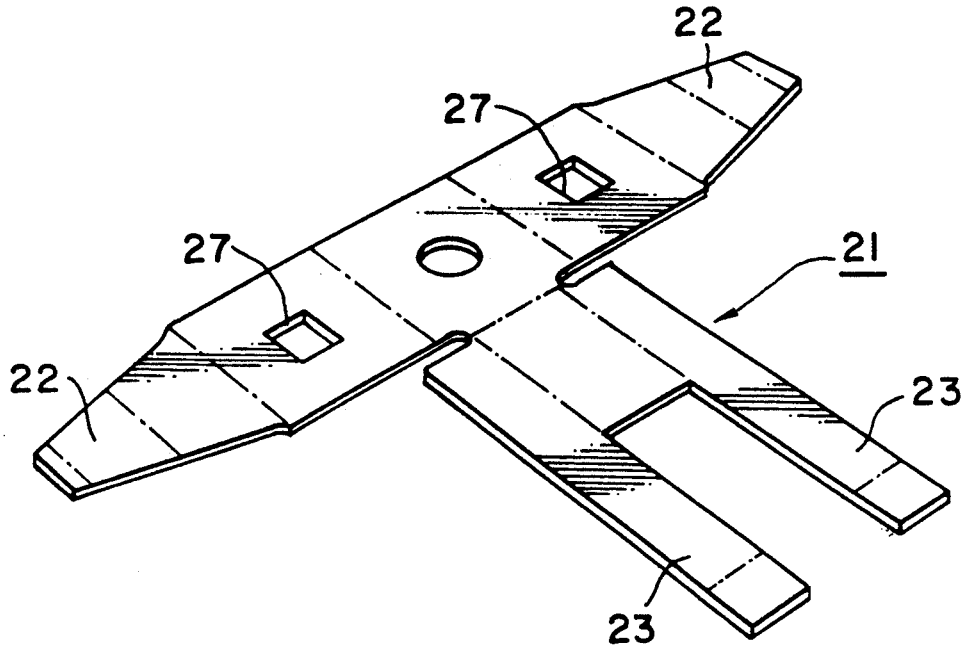
Figure 20:
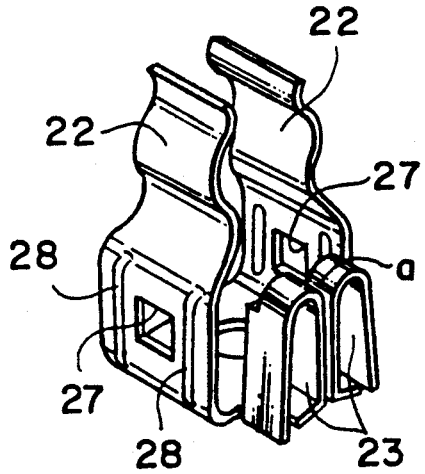
Figure 21:
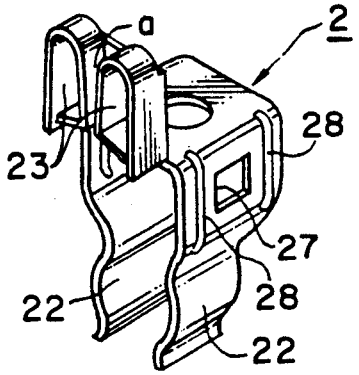
Figure 24:
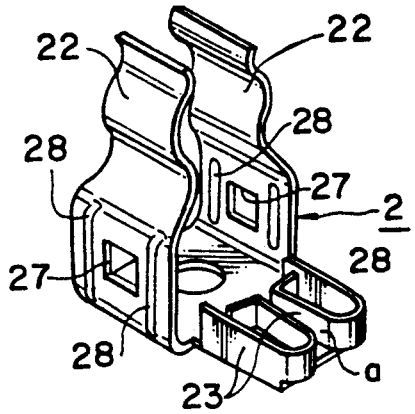
Figure 22:
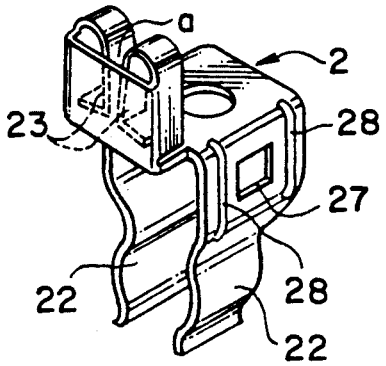
Figure 25:
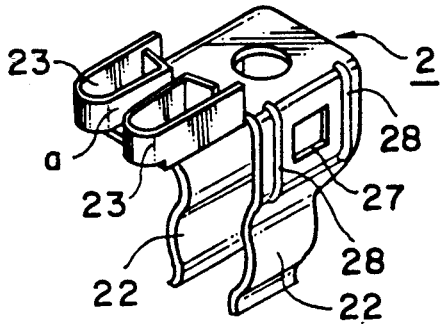
Figure 23:
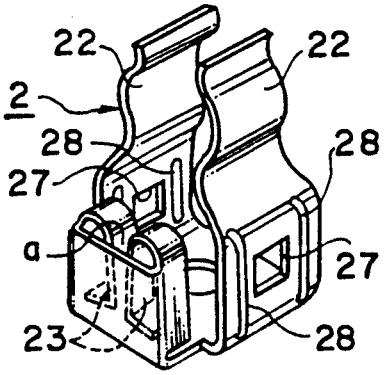
Figure 26:
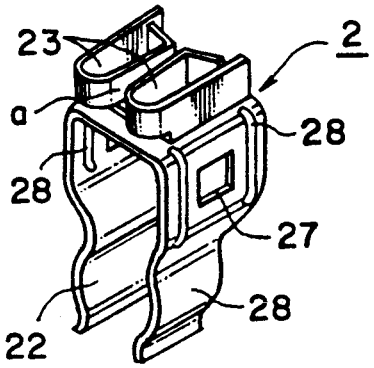
Figure 29:
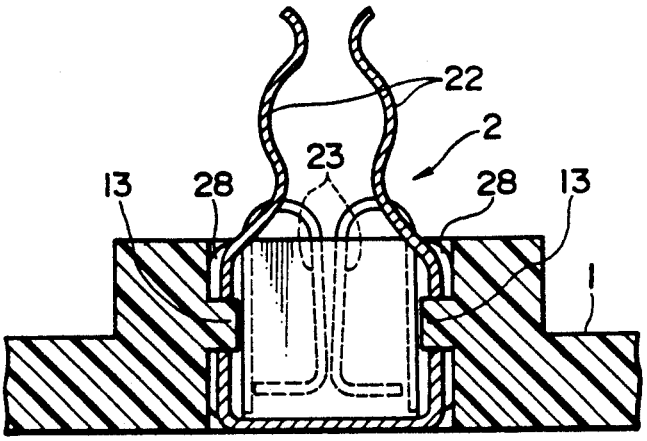
Figure 30:
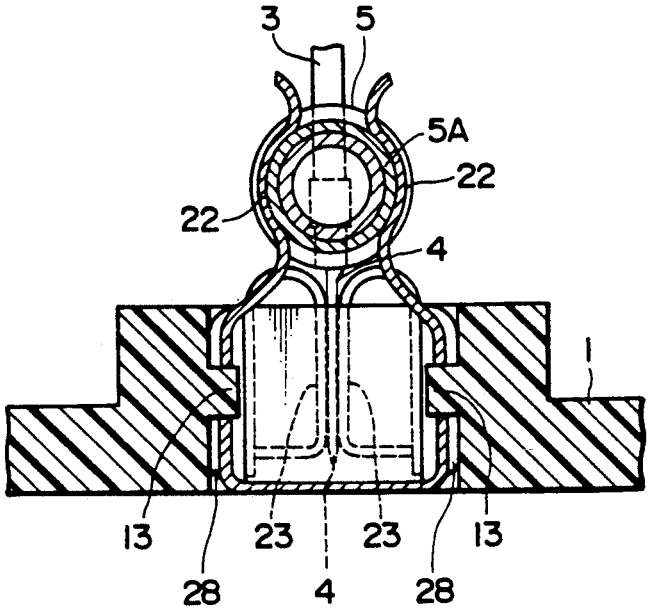
Figure 31:
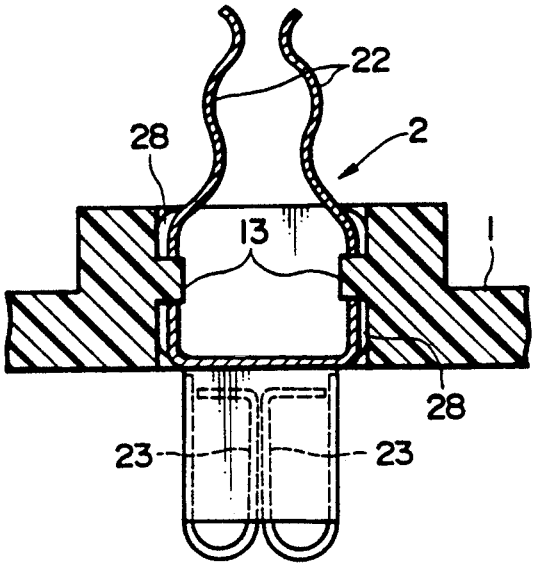
Figure 32:
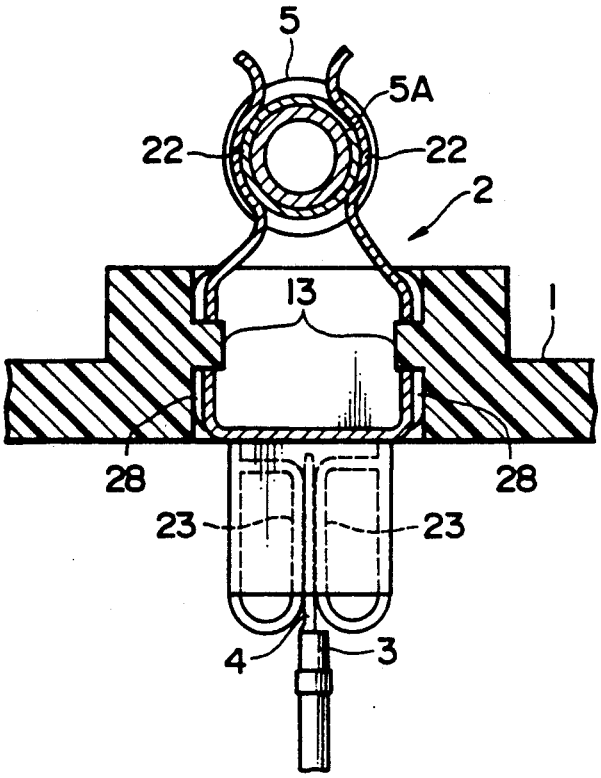
Figure 33:
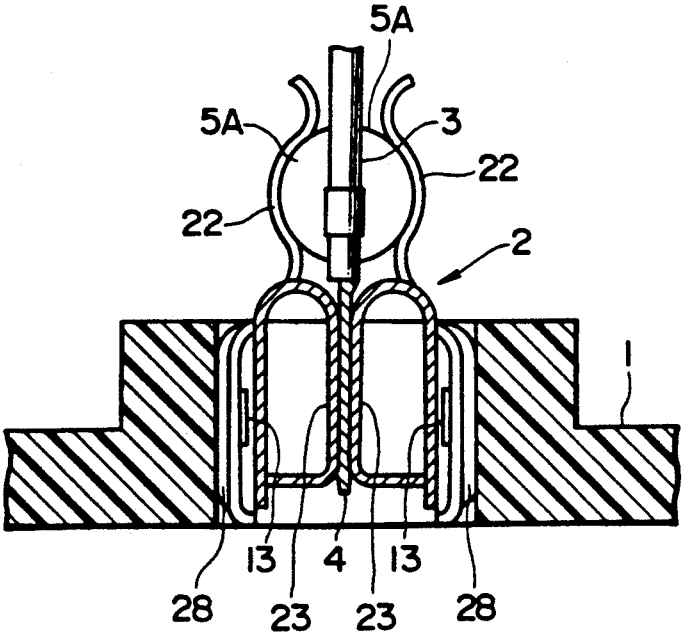

As shown in FIGS. 17 to 20, the clamp type connection devices according to the present invention can comprise an insulating substrate 1 having a connector mounting portion 12 provided with confronting lugs 13 formed thereto as shown in FIG. 17. Connectors 2 each integrally provided with a pair of clamping pieces 22 and made of a resilient conductive plate formed to a shape shown in FIG. 19 and also provided. In addition, these embodiments have dual plug-in contact pieces 23 as shown in FIGS. 17 and 20. The connectors 2 are mounted on the connector mounting portion 13 by means of the lugs 13 extending into the mounting holes 27 formed at each base of the clamping pieces as shown in FIGS. 18 and 29.

In the above embodiments, the plug-in connection piece 23, can be formed in different orientations as shown in FIGS. 21 to 26.

Figure 27:
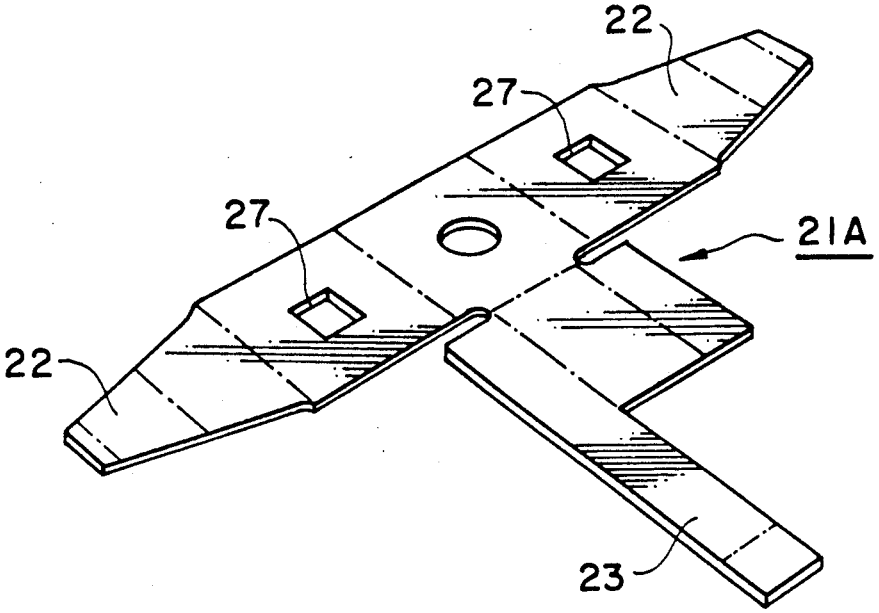
Figure 28:
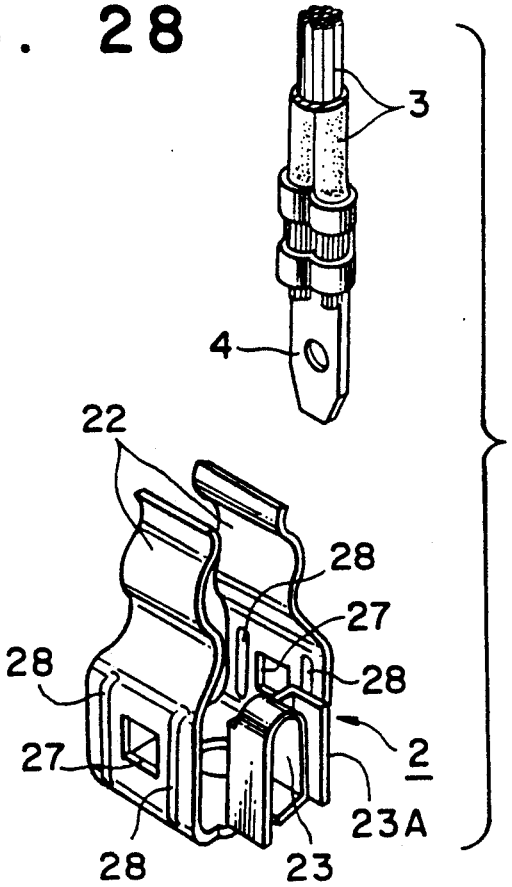

Furthermore, a conductive plate having a shape shown in FIG. 27 maybe formed into a shape as shown in FIG. 28 such a dual side face contact asymmetrical plug-in connection piece 23 having a conductive piece 23A may be integrally formed with a connector 2.

Note that each of FIGS. 29 to 33 is a cross-sectional view of a main part of an embodiment of a connector 2 mounted on an insulating substrate 1, wherein the same reference numerals as used in the above embodiments are used to designate the same structural components.

Since the above embodiments shown in FIGS. 17 to 33 include the dual side face contact type plug-in connection piece 23, the tab terminal 4 and the narrow conductive plate 6 (bus bar) are in tight press-fitted contact so that electrical resistance is minimized and thus less heat is produced therefrom.

The clamp type connection device according to the present invention can also be provided as shown in FIGS. 34 to 51.

Figure 34:
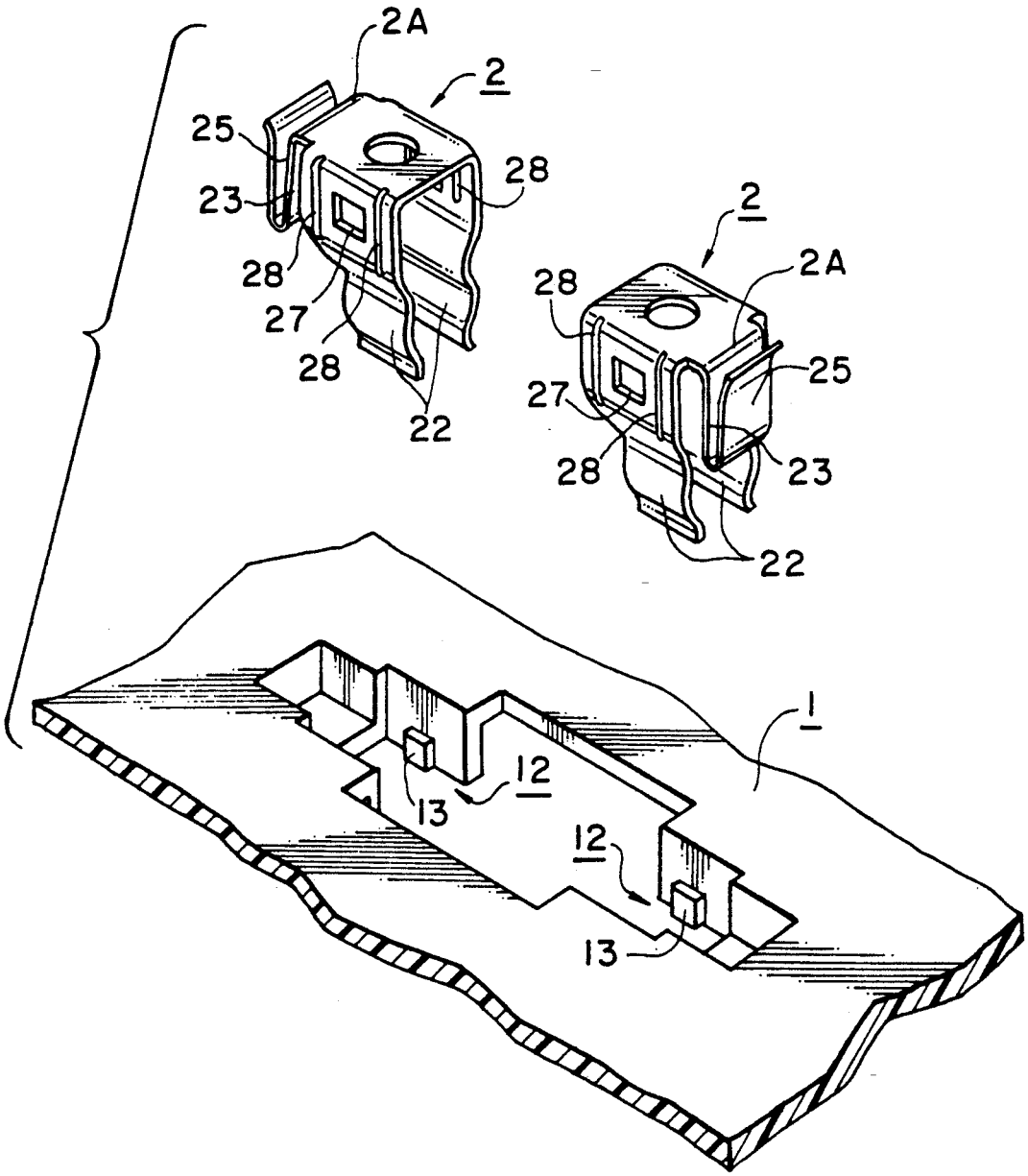
Figure 35:
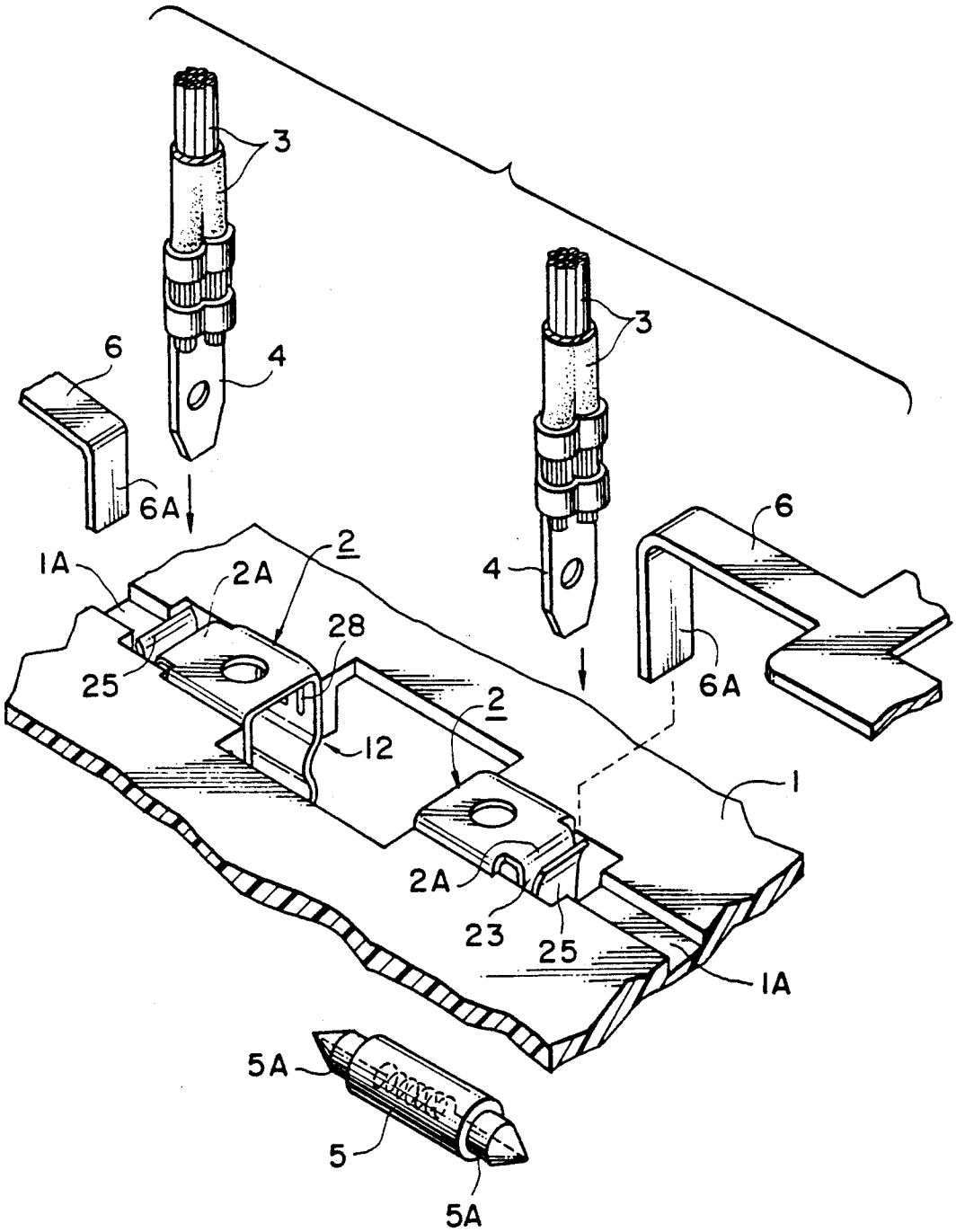
Figure 36:
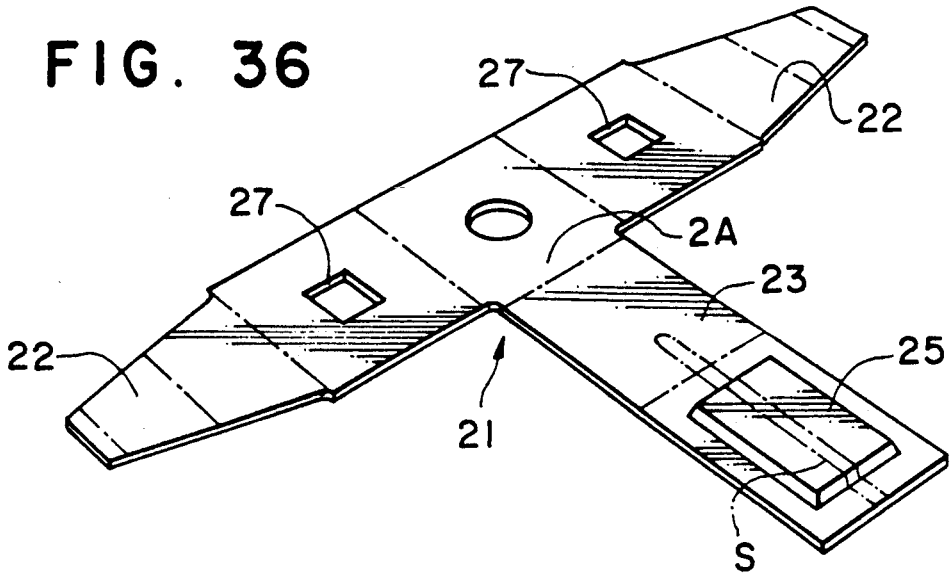
Figure 37:
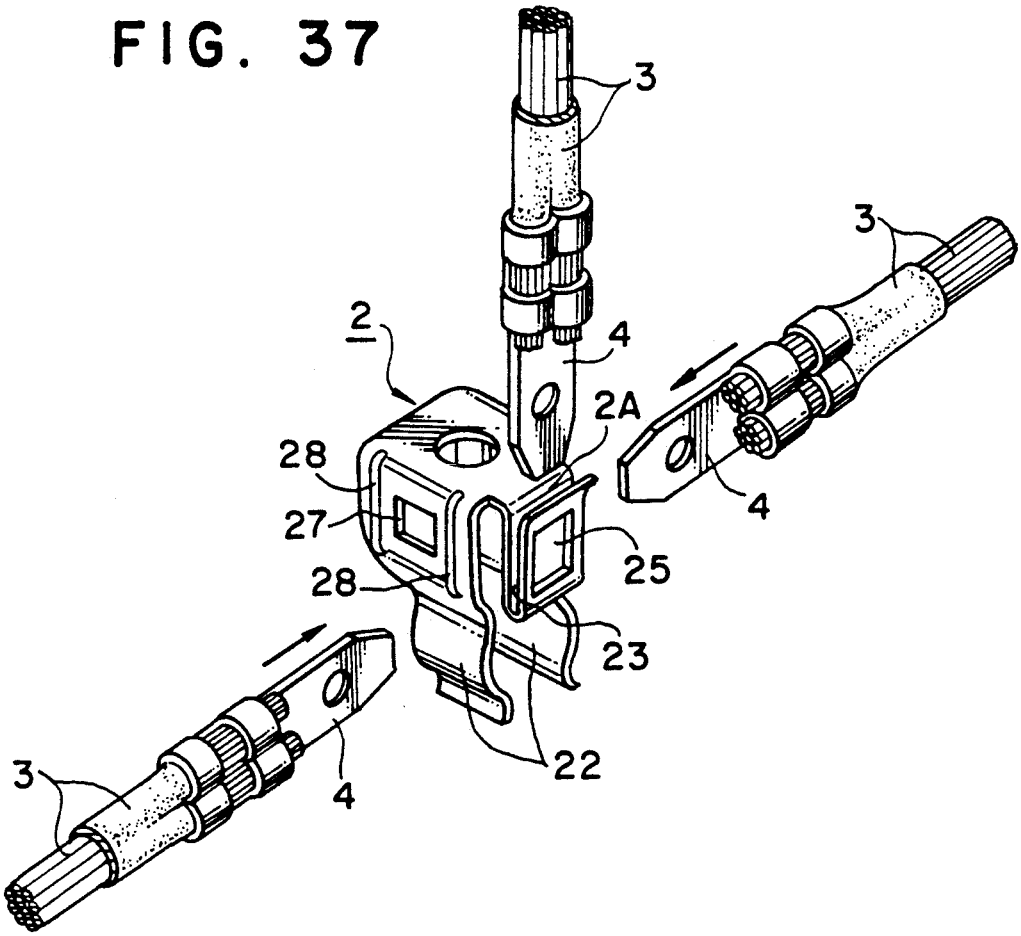
Figure 38:
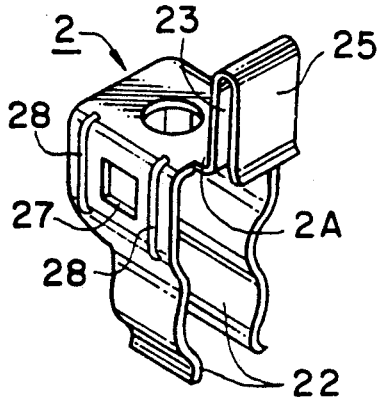
Figure 41:
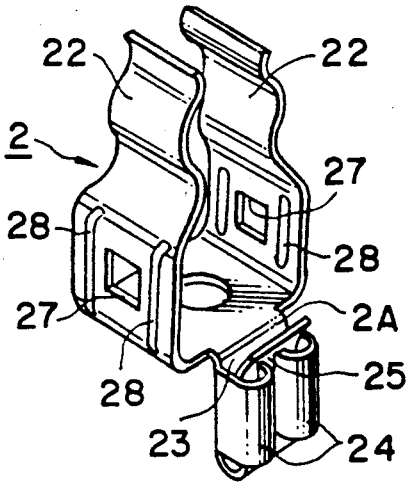
Figure 39:
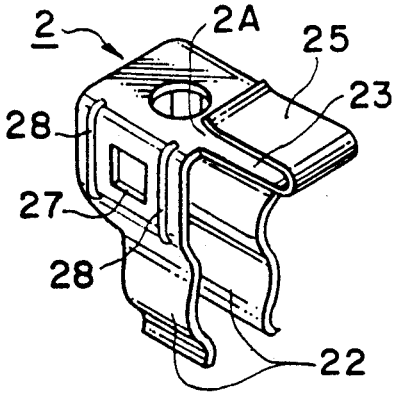
Figure 42:
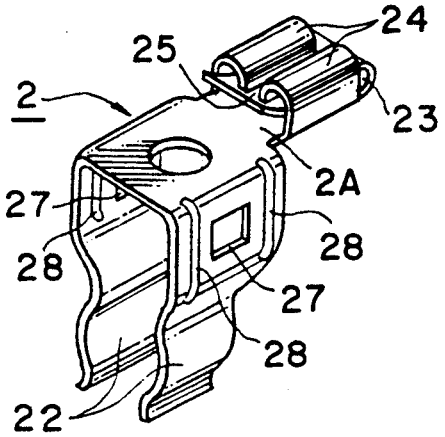
Figure 40:
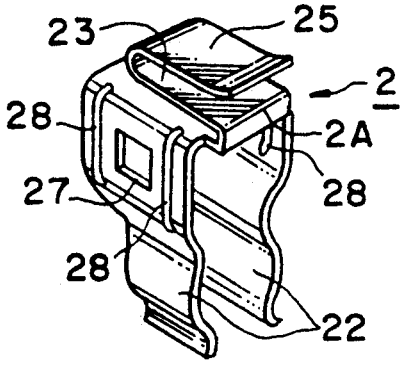
Figure 43:
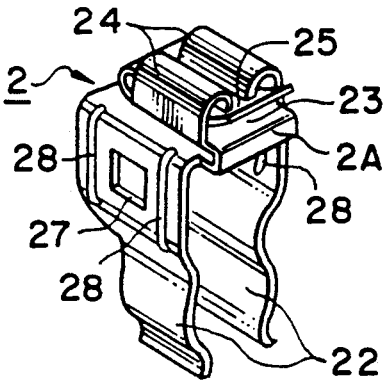
Figure 44:
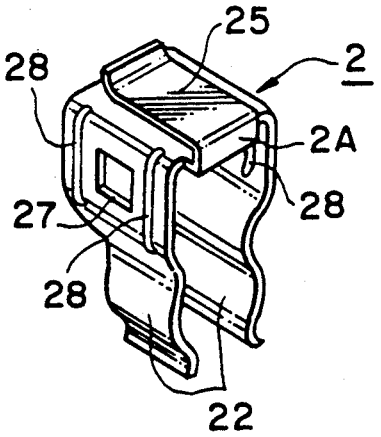
Figure 47:
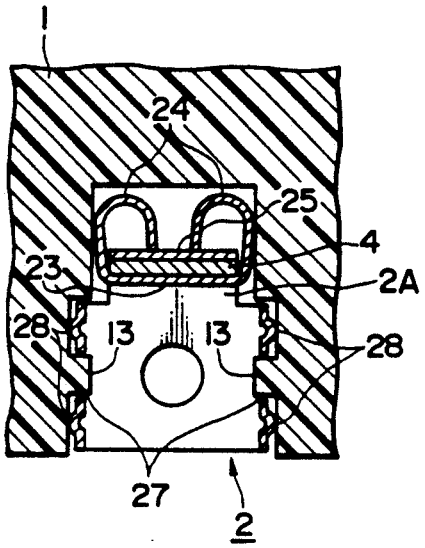
Figure 48:
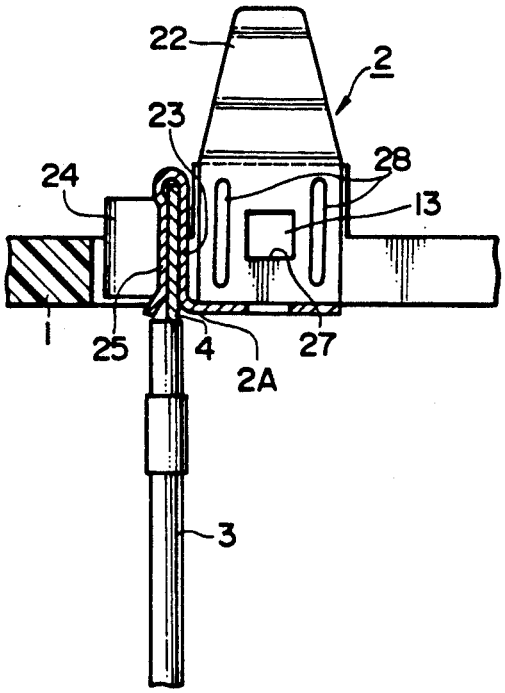
Figure 49:
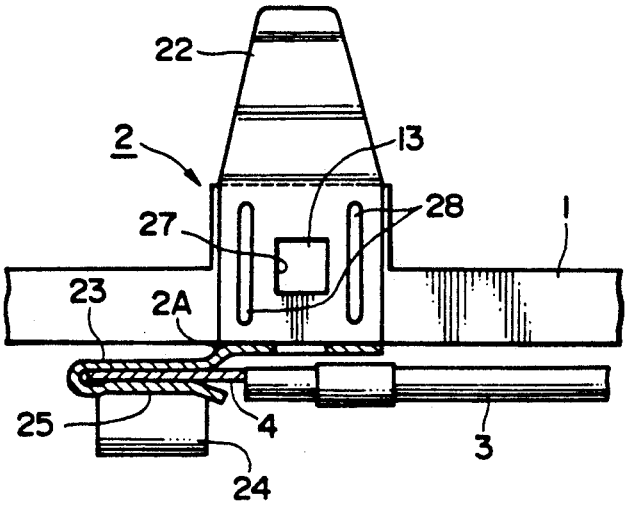
Figure 50:
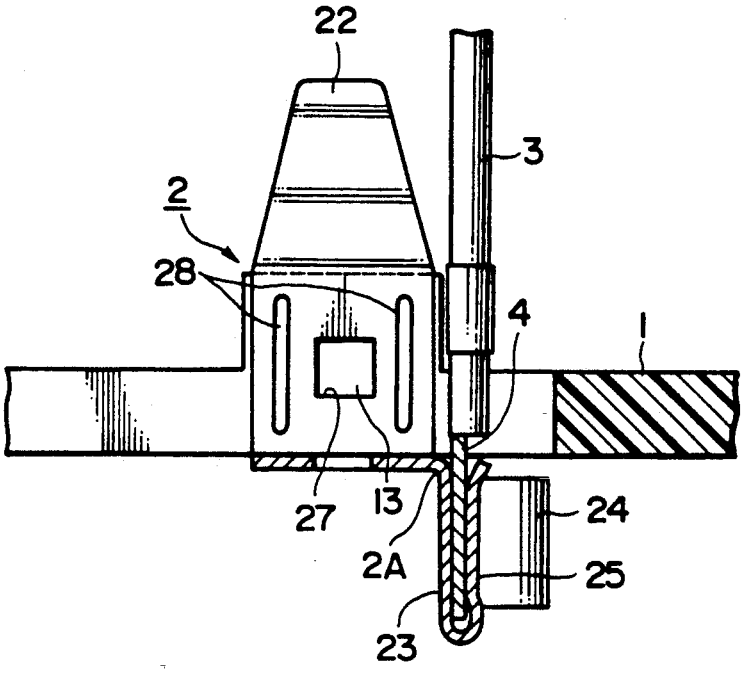
Figure 51:
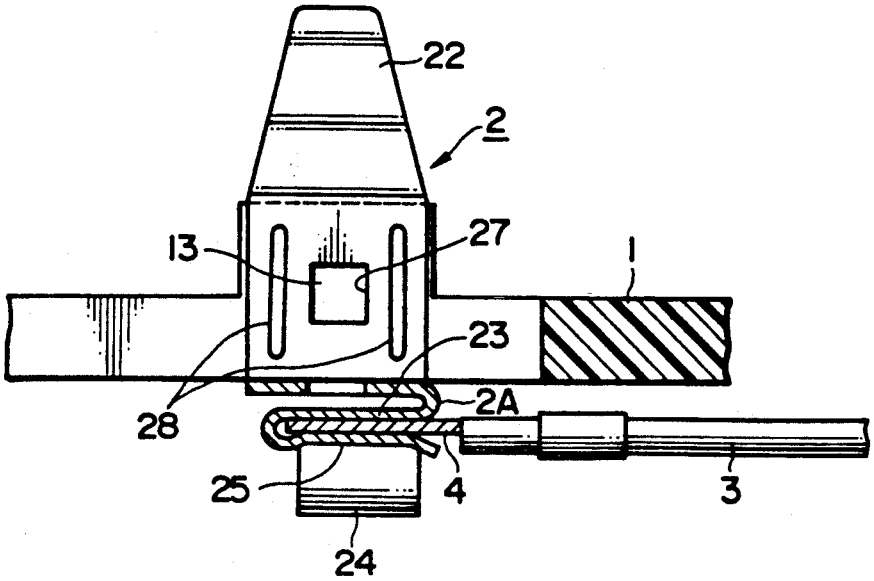

More specifically, as shown in FIGS. 34 to 37, a clamping type connection device comprises an insulating substrate 1 having a connector mounting portion 12 provided with confronting lugs 13. Connectors 2 each provided with a pair of clamping pieces 22 are made from a resilient conductive plate formed into a shape shown in FIG. 36. Mounting holes 27 are defined on each base of the clamping pieces 22. A confronting conductive piece 25 is formed by folding a conductive piece 23A which projects from the base 2A of each of the connectors 2 into a U-shape as shown in FIGS. 34 and 37. The above-described connectors 2 are mounted on the connector mounting portion 12 by engaging the lugs 13 within mounting holes 27 of the substrate 1 as shown in FIGS. 35, 47 and 50.

Figure 45:
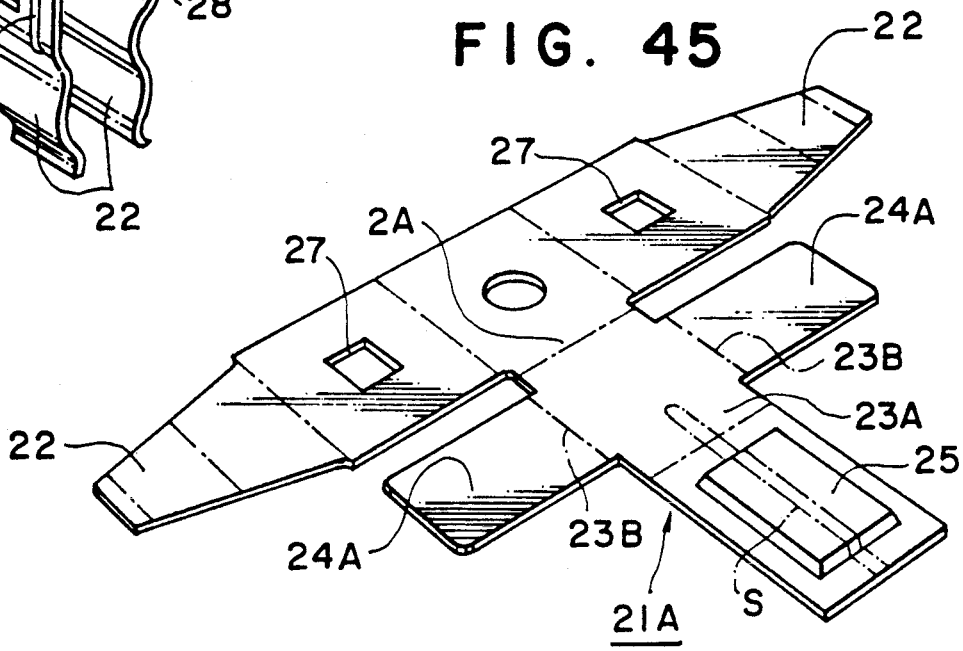
Figure 46:
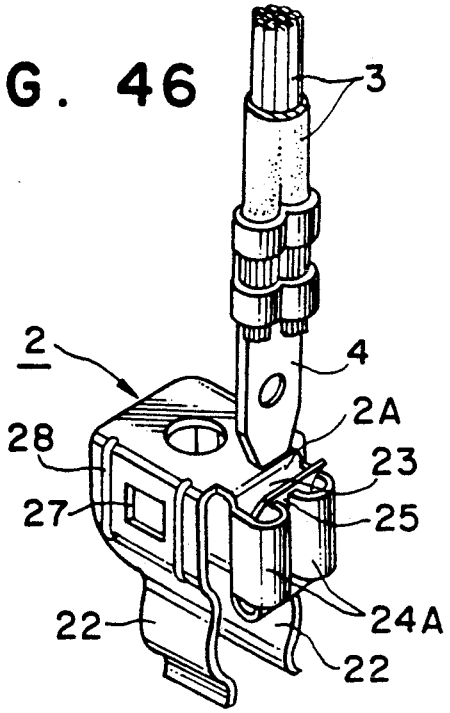

When the outer surface of the confronting conductive piece 25 is pressed by support pieces 24A (formed by folding a conductive plate shown in FIG. 45 into a U-shape at the sides 23B of a conductive piece 23A) as shown in FIG. 46, the strength by which the tab terminal 4 is inserted into the plug-in piece 23 is increased.

Note that, as shown in FIGS. 36 and 45, when a slit S is defined at substantially the center of the confronting conductive piece 5, the single confronting conductive piece is divided into two portions and tab terminals 4 having a different thickness can be especially tightly inserted to the opposite sides thereof using the slit S as a border-line.

In another embodiment, the plug-in connection piece 23 composed of dual side face type contact elastic pieces integrally formed with the connector 2 can also provide in different orientations as shown in FIGS. 38 to 44.

Note that each of FIGS. 47 to FIG. 51 is a cross sectional view of a main part of an embodiment of a connector 2 mounted to an insulating substrate 1, wherein the same reference numerals as used in the above embodiments are used to designate the same structural members.

The lamp type connection device according to the present invention can also be achieved as shown in FIGS. 52 to 71.

Figure 52:
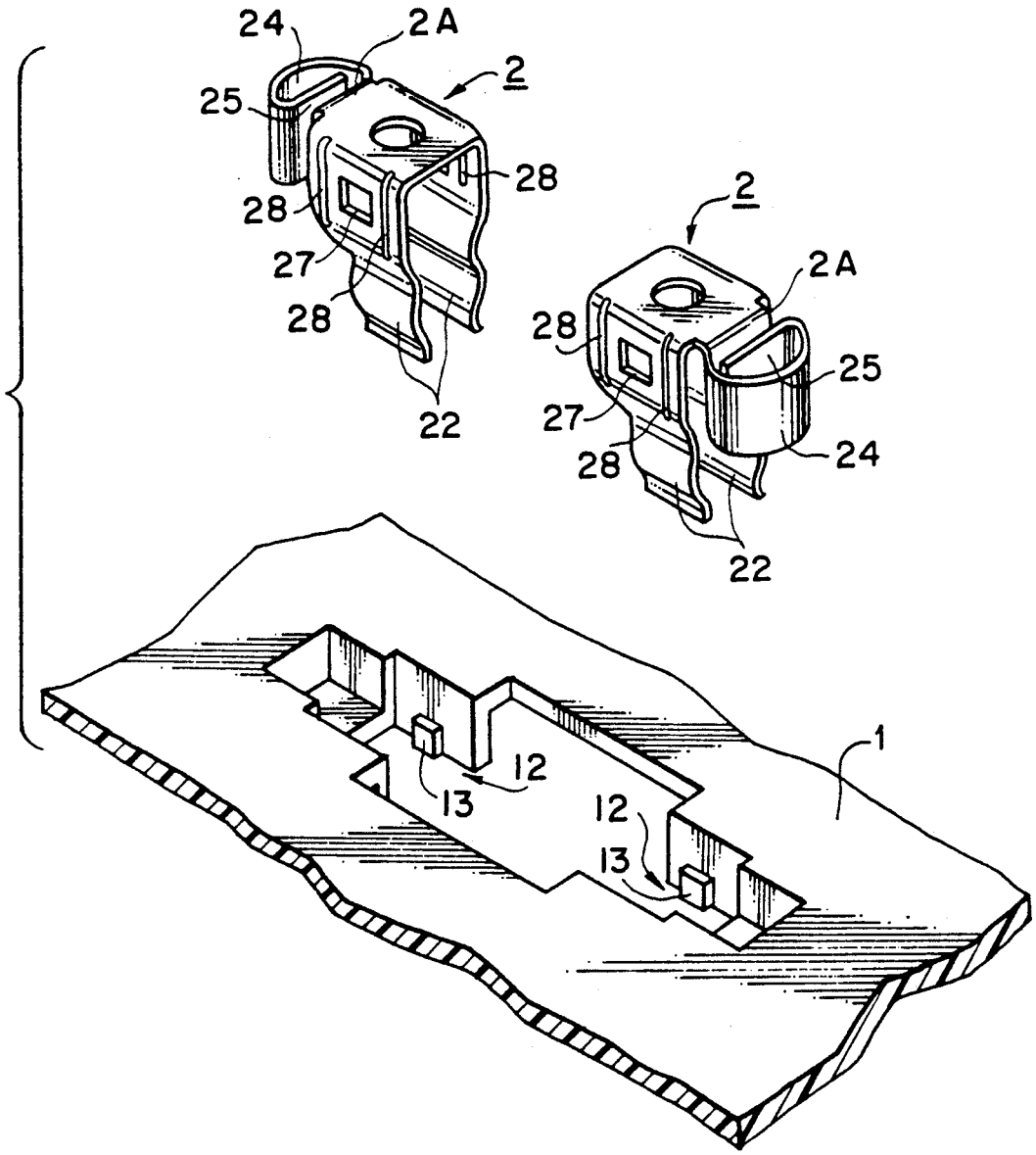
Figure 53:
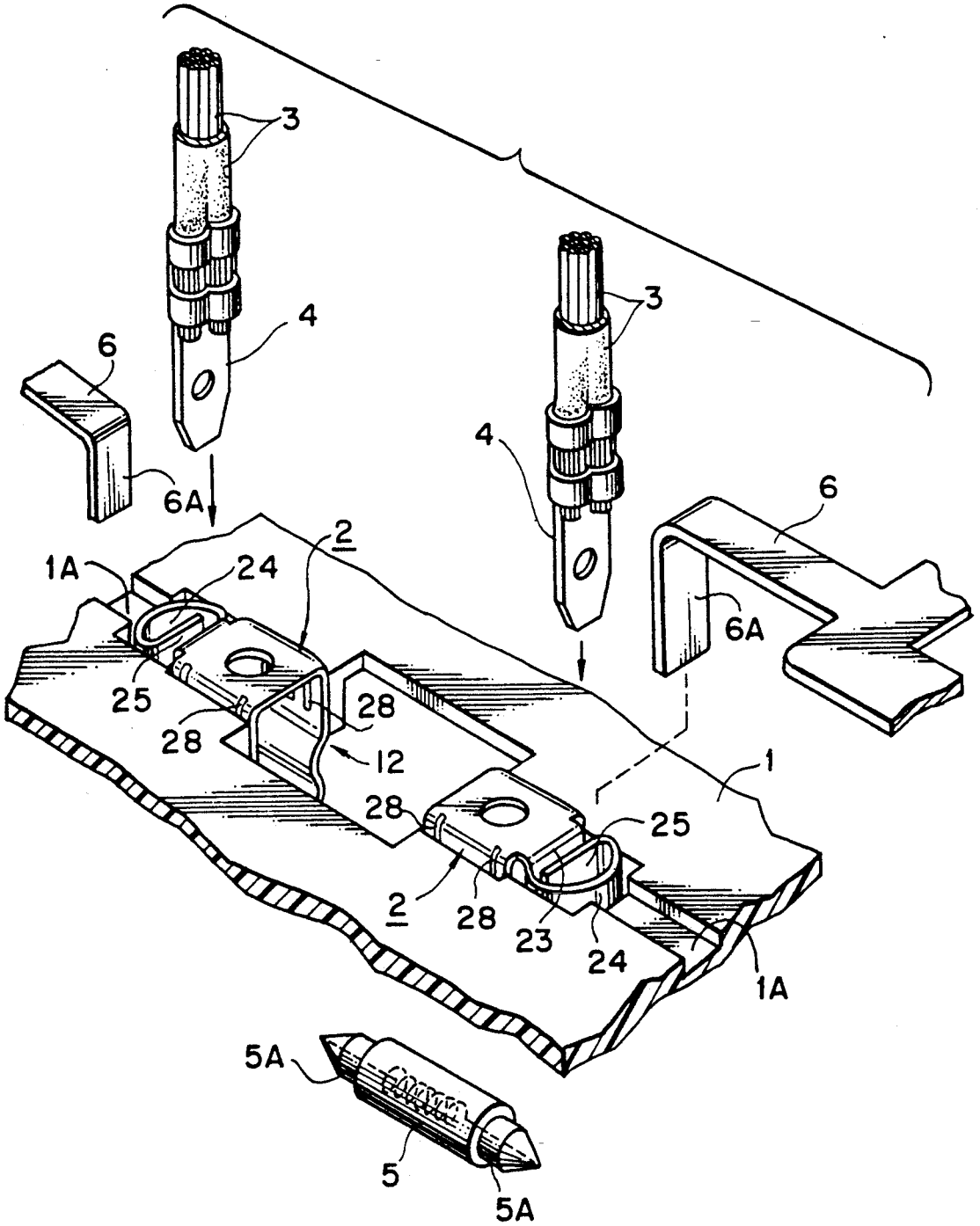
Figure 56:
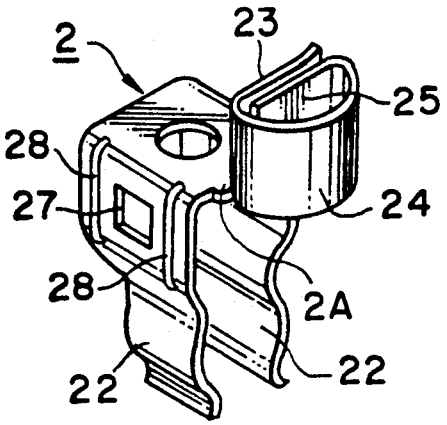
Figure 59:
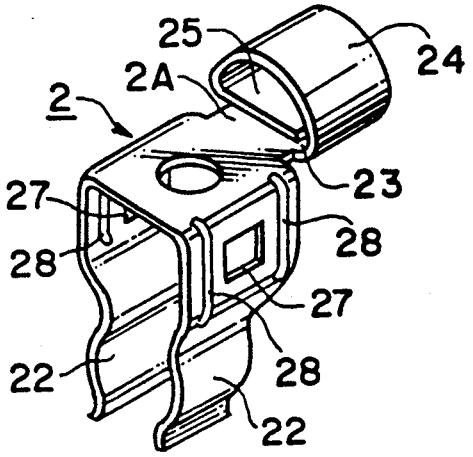
Figure 57:
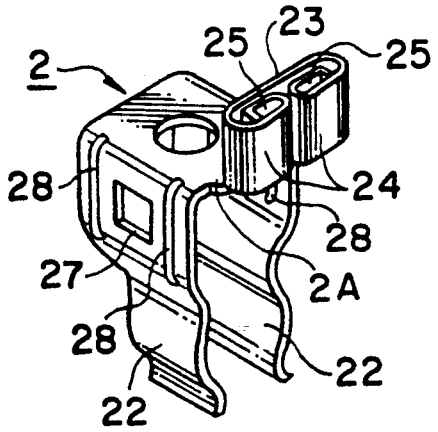
Figure 60:
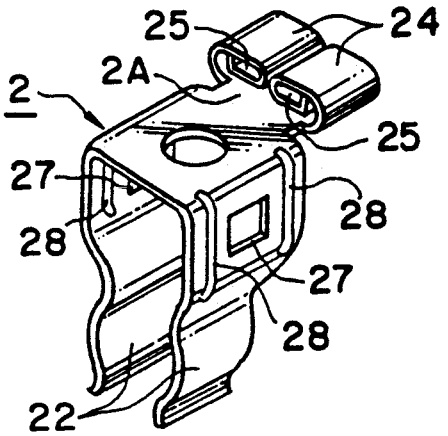
Figure 58:
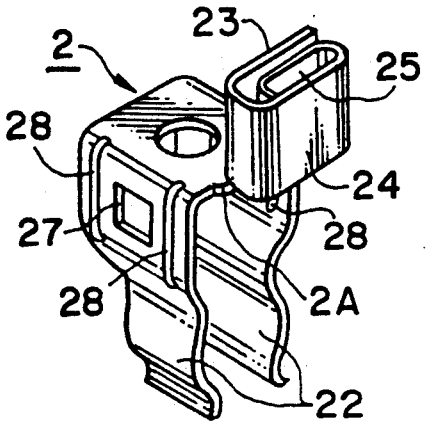
Figure 61:
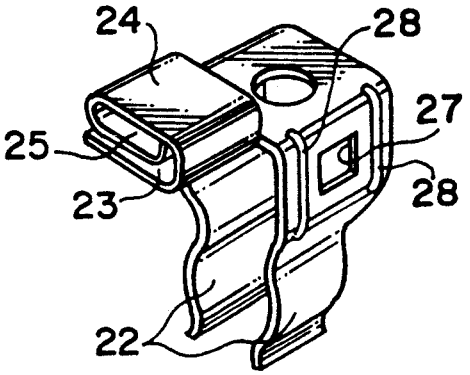
Figure 62:
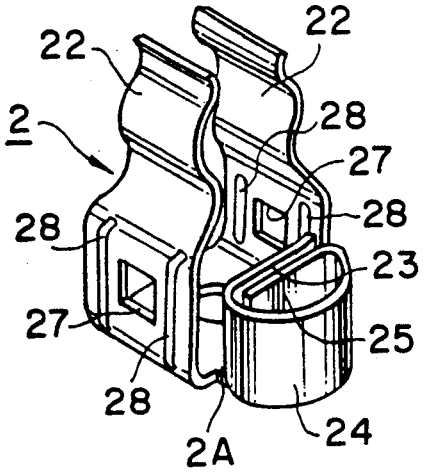
Figure 63:
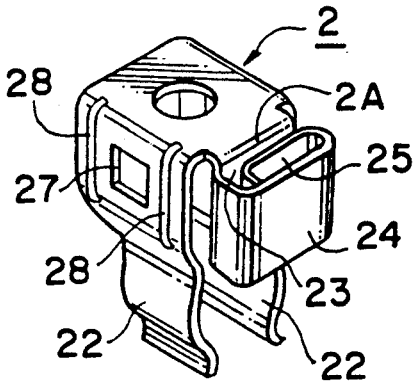
Figure 66:
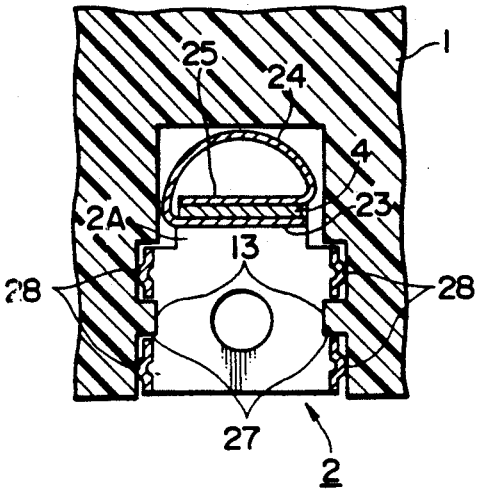
Figure 67:
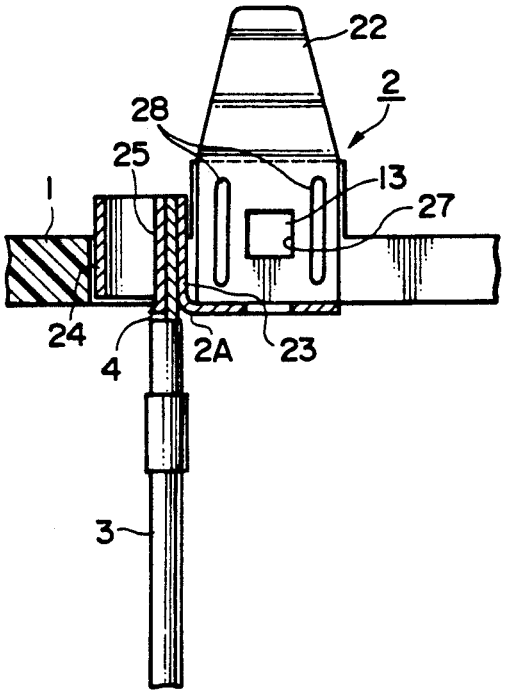
Figure 68:
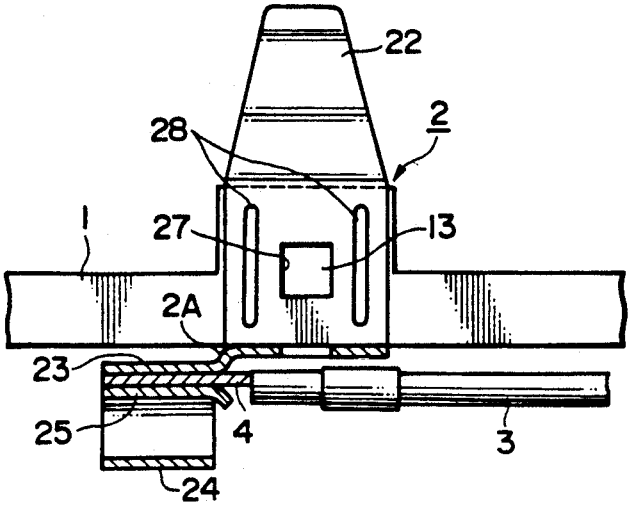
Figure 69:
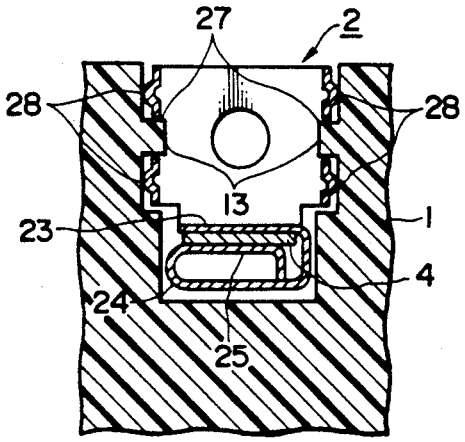
Figure 70:
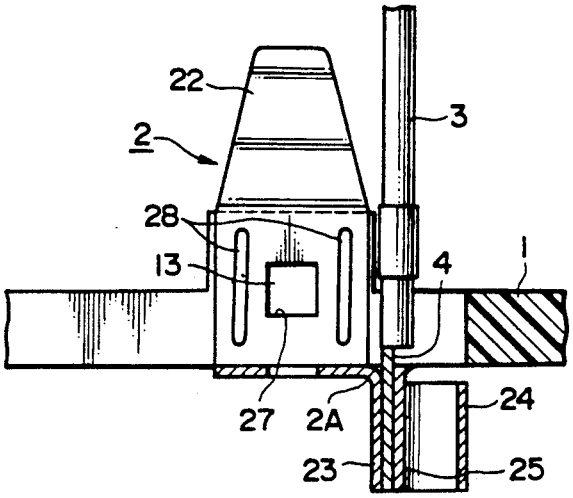
Figure 71:
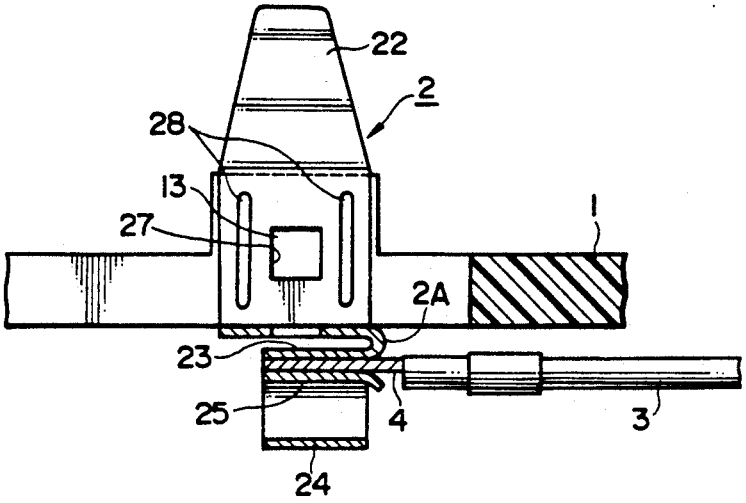

More specifically, as shown in FIGS. 52 to 55, a clamping type connection device comprises an insulating substrate 1 having a connector mounting portion 12 provided with confronting lugs 13 shown in FIG. 52. Connectors 2 are each provided with a pair of clamping pieces 22 made of a conductive plate having elasticity as shown in FIG. 54. Mounting holes 27 are defined in each base of the clamping pieces 22. A confronting conductive piece 25 is folded into a U-shaped portion 24 from the side 23B of a conductive piece 23A which project from the base 2A of each of the connectors 2 as shown in FIG. 55. The connectors 2 are thus mounted on the connector mounting portion 12 by engaging the lugs 13 with the mounting holes 27 as shown in FIG. 53 and 66.

Figure 64:
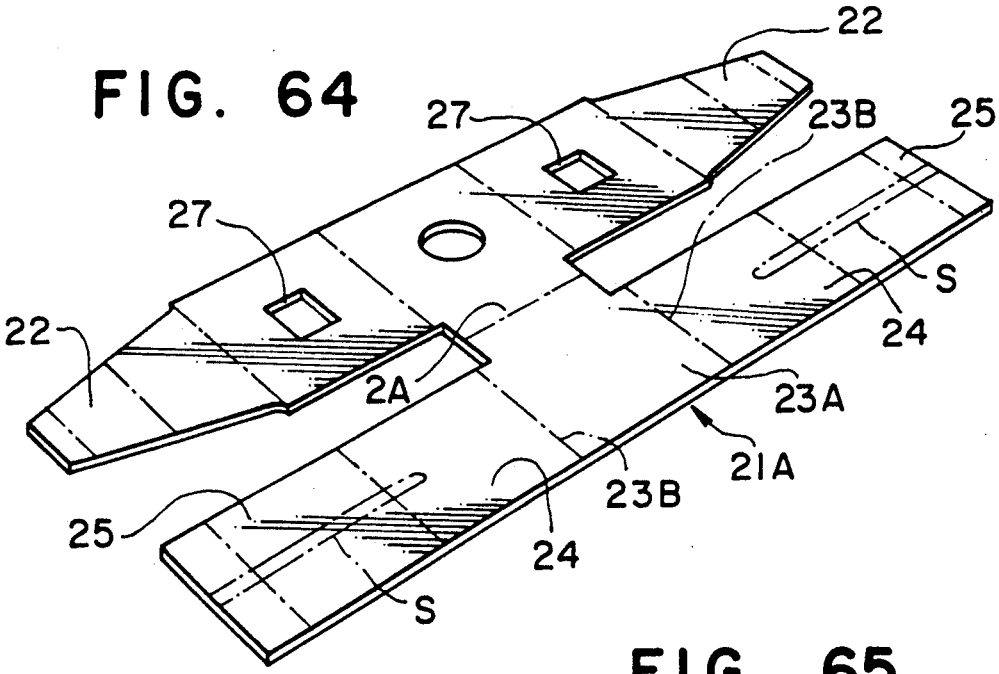

Note that, as shown in FIG. 54 and 64, when a slit S is defined at substantially the center of the confronting conductive piece 25, the single confronting conductive piece is divided into two portions and tab terminals 4 having a different thickness can be especially tightly inserted into the opposite sides thereof using the slit S as a border-line.

In this embodiment, the plug-in connection piece 23 can be also formed in different orientations as shown in FIGS. 56 to 63. Alternatively, two confronting conductive pieces 25, 25 can be formed as a pair.

Figure 65:
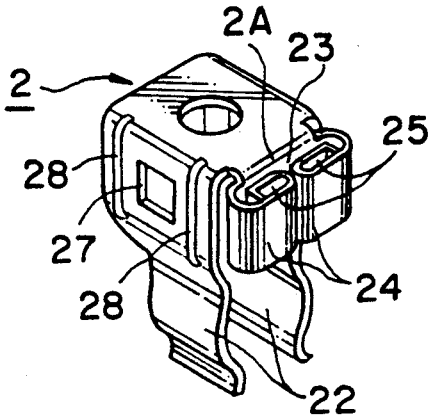

More specifically, the pair of conductive pieces may be formed in such a manner that a conductive plate having a flat shape as shown in FIG. 64 may be formed into the shape shown in FIG. 65 so that the confronting conductive pieces 25 of dual side face contact type symmetrical plug-in piece 23 are integrally formed with the connector 2.

Each of FIGS. 66 to 71 is a cross sectional view of a main part of an embodiment of a connector mounted to an insulating substrate 1, wherein the same numerals as used in the above-described embodiments are used to designate the same structural members.

Since a pair of clamping pieces 22 ad the plug-in connection piece 23 having the plug-in connection portion a are integrally formed with a single connector 2, the devices of the present invention can be realized using less resources at lower costs. Furthermore, a straight tube lamp, glass tube fuse or the like can be held tightly by the pair of clamping pieces 22 in use. The tab terminal 4, narrow conductive plate 6 (bus bar), the partially cutout cylindrical connection plug 4A or the like can also be directly and tightly inserted into the plug-in connection piece 23. As a result, contact resistance can be minimized and thus less heat is produced. Finally, soldering irons, caulking tools and the like required by conventional connector devices are not needed according to the present invention. Thus, the present invention has many beneficial effects. For example, the task of connecting wires and the like can now be easily carried out in a narrow and/or dark location (such as the engine compartment of an automobile).

Since the mounting holes 27, 27 are defined on each base of a pair of the clamping pieces 22 and the raised ribs 28 are defined at the outside surface thereof, resistance heat produced by electrical current during operation can be effectively dissipated by the chimney effect provided by the space defined between the connector 2 and the mounting portion 12. Thus, the insulating substrate, as well as the lead wire insulation, are not adversely affected by such heat. In addition, the flexural rigidity of the bases of the clamping pieces is maintained.

Since the outer surface of the confronting conductive piece 25 can be pressed by the support piece 24, an external conductive piece such as a tab terminal 4 can be more tightly inserted into the plug-in connection piece 23. Thus, electrical contact can be maintained for prolonged time periods and thus contact resistance can be maintained at reduced levels in use.

What is claimed is:

1. A clamp-type electrical connector comprising an electrically insulating substrate, and connectors mounted on said insulating substrate, wherein (a) said electrically insulating substrate includes a connector mounting portion having confronting lugs formed thereon;

(b) said connectors are each integrally provided with (i) a pair of clamping pieces each made of an elastic electrically conductive plate having an electrically conductive base which defines a mounting hole, and (ii) an electrically conductive plug-in connection piece adapted to resiliently engage an electrical component to establish electrical connection therewith;

(c) each of said connectors being mounted on said connector mounting portion by means of said lugs engaging a respective one of said mounting holes defined on the base of said clamping pieces;

(d) said base of each of said clamping pieces also has a pair of raised ribs which contact a surface of said connector mounting portion so as to establish a space between said clamping piece and said surface of said connector mounting portion through which heat generated during use may be vented; and wherein (e) an integral side of each of said connectors forms a support piece which is folded back onto a surface of a respective said plug-in connection piece to thereby press against said surface and thereby increase the resilient engagement exerted by said plug-in connection piece against the electrical component.

2. A clamp-type electrical connector as in claim 1, wherein said plug-in connection piece is in the form of a dual side face type contact piece.

3. A clamp-type electrical connector comprising an insulating substrate, and connectors mounted on said insulating substrate, wherein (a) said insulating substrate includes a connector mounting portion having confronting lugs formed thereon;

(b) said connectors are each integrally provided with a pair of clamping pieces each made of an elastic conductive plate and having a base which defines a mounting hole;

(c) a plug-in connection piece which includes a confronting conductive piece formed by folding a conductive piece which projects from the base of each of said connectors into a U-shape;

(d) each of said connectors being mounted on said connector mounting portion by means of said lugs engaging a respective one of said mounting holes defined on the bases of said clamping pieces; and wherein (e) a folded U-shaped side of said conductive piece forms a support piece which presses against the outer surface of said confronting conductive piece.

4. A clamp type connection device according to claim 3 wherein a slit S is defined at substantially the center of said confronting conductive piece.

5. An electrical connector comprising:

an electrically insulating base member having a connector mounting portion which defines an interior surface;

at least one pair of mounting lugs which extend from said interior surface of said connector mounting portion;

a pair of spaced-apart clamp-type electrically conductive connectors each including a clamp member having a generally U-shaped portion for resiliently engaging an electrical component so as to establish electrical connection therebetween, each said electrically conductive connector defining a mounting hole for receiving a respective one of said mounting lugs, whereby said connectors are mounted to said insulating base member; and vent means for dissipating heat generated during use, said vent means including rib means integrally formed on said pair of connectors and engaging an opposing portion of said interior surface of said insulating base member so as to establish a vent space between said connectors and said interior surface, whereby heat may dissipate therethrough;

wherein each of said connectors includes a plug-in connection piece for receiving an electrical terminal and effecting electrical contact therewith; and wherein each said plug-in connection piece includes an integral side support piece which is folded back onto said plug-in connection piece to press against an outer surface thereof to thereby increase the resilient engagement which said plug-in connection piece exerts upon the electrical terminal.

6. An electrical connection as in claim 5, wherein each said plug-in connection piece defines a generally centrally located slit.

7. An electrical connector comprising:

an electrically insulating base member having a connector mounting portion; and a pair of spaced-apart clamp-type electrically conductive connectors mounted to said connector mounting portion of said electrically insulating base member, wherein each said connector includes a clamp member having a generally U-shaped portion for resiliently engaging an electrical component so as to establish electrical connection therebetween, and a connection piece for receiving an electrical terminal and wherein each said clamp-type connector includes an integral side support piece which is folded back onto said connection piece to press thereagainst and thereby increase the resilient engagement which said connection piece exerts upon the electrical terminal.

8. An electrical connector as in claim 7, wherein said connector mounting portion of said electrically insulating base member defines an interior surface having at least one pair of mounting lugs extending therefrom, and wherein said electrically conductive connectors each define a mounting hole for receiving a respective one of said mounting lugs therewithin, whereby said connectors are mounted to said insulating base member.

9. An electrical connector as in claim 7, wherein said electrical connectors are each provided with a generally centrally located slit.

* * * * *